US008626011B2

(12) United States Patent
Yamada

(10) Patent No.: US 8,626,011 B2
(45) Date of Patent: Jan. 7, 2014

(54) IMAGE FORMING APPARATUS THAT CHANGES AC VOLTAGE DUTY RATIO

(75) Inventor: Toshiyuki Yamada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 301 days.

(21) Appl. No.: 12/825,562

(22) Filed: Jun. 29, 2010

(65) Prior Publication Data

US 2010/0329707 A1 Dec. 30, 2010

(30) Foreign Application Priority Data

Jun. 30, 2009 (JP) ..... 2009-154463

(51) Int. Cl.
*G03G 15/00* (2006.01)

(52) U.S. Cl.
USPC ..... 399/44; 399/45; 399/66

(58) Field of Classification Search
USPC ..... 399/44, 45, 66
See application file for complete search history.

(56) References Cited

U.S. PATENT DOCUMENTS 6,324,359 B1 * 11/2001 Nakane ..... 399/66
2008/0145084 A1 * 6/2008 Toizumi et al. ..... 399/66
2010/0303518 A1 * 12/2010 Aimoto et al. ..... 399/314

FOREIGN PATENT DOCUMENTS

JP 2006-267486 A 10/2006

* cited by examiner

*Primary Examiner* — Ryan Walsh
(74) *Attorney, Agent, or Firm* — Fitzpatrick, Cella, Harper & Scinto

(57) ABSTRACT

An image forming apparatus includes a rotatable image bearing member for bearing a toner image; a transfer member constituting a transfer portion for transferring the toner image formed on the image bearing member onto a recording material; a voltage source for applying, to the transfer member, a voltage in the form of superimposed DC voltage and AC voltage; a controller for controlling the voltage source such that a duty ratio of the AC voltage is changed in accordance with a kind of the recording material; and an executing portion for executing an operation in an image forming mode in which the toner image is transferred from the image bearing member onto the recording material with the duty ratio controlled by the controller.

21 Claims, 9 Drawing Sheets

(a) PLAIN PPR : DUTY RT = 50%

(b) EMBOSSED SHEET : DUTY RT = 30%

IMAGE FORMING APPARATUS THAT CHANGES AC VOLTAGE DUTY RATIO

FIELD OF THE INVENTION AND RELATED ART

The present invention relates to an image forming apparatus which transfers a toner image from its image bearing member onto recording medium while keeping the recording medium pinched between the image bearing member and the transferring member of the apparatus. More specifically, it relates to the control of the transfer voltage to be applied to transfer a toner image onto such recording medium as a sheet of embossed paper that is relatively rough in surface texture.

Image forming apparatuses which transfer a toner image from their image bearing members onto recording medium by applying electric voltage to a transferring member while keeping pinched recording medium between an image bearing member (photosensitive members or intermediary transferring member) and the transferring member are widely in use. It has been known that if these image forming apparatuses are used to form an image on a sheet of embossed paper, that is, a sheet of paper embossed with three-dimensional pattern, toner is unlikely to be satisfactorily transferred onto the recessed portions of the sheet (Japanese Laid-open Patent Application 2006-267486).

Japanese Laid-open Patent 2006-276486 discloses an image forming apparatus structured so that its secondary transfer portion is formed by pressing its transfer roller upon its intermediary transfer belt. More specifically, the transfer roller is pressed upon the portion of the intermediary transfer belt, which is backup by a backup roller which backs up the intermediary transfer belt from the inward side of the loop which the belt forms. In other words, the transfer roller is pressed upon the portion of the intermediary transfer belt, which is bent in curvature by the backup roller. When this image forming apparatus is used for forming an image on a sheet of embossed paper, an AC voltage which is 2 kHz in frequency and 1 kV in effective voltage is applied, in addition to the DC voltage, to the transfer roller of the apparatus. Thus, even if there is a gap between the bottom portion of each recess of the embossed paper and the image bearing member of the apparatus, the application of the AC voltage in addition to the DC voltage can generate an electric field capable of causing toner particles to be ejected from the image bearing member. In other words, it can ensure that even the portions of the toner image, which correspond in position to the recessed portions of the sheet of embossed paper, that is, the image portions which are unlikely to be satisfactorily transferred onto the sheet of embossed paper if the voltage applied to the transfer roller is only a DC voltage of 2 kV, are transferred onto the corresponding portions (recessed portions) of the sheet of embossed paper.

It was confirmed, by experiments in which a combination of DC and AC voltages was applied to transferring portion to transfer a toner image onto a sheet of embossed paper, that the application of a combination of DC and AC voltages caused an image forming apparatus to yield images which were low in image quality in that the portions of the image, which corresponded to the recessed portions of the sheet of embossed paper, appeared blotted than the adjacent portions. The reason for the formation of images such as the above-mentioned ones seems to be as follows: The application of the AC voltage in addition to the DC voltage caused toner particles to reciprocally move between the image bearing member and recording medium, causing thereby the amount by which toner particles uncontrollably scattered. Thus, resultant letters and/or line drawings appeared blotted.

Thus, the AC voltage to be applied in addition to the DC voltage was reduced in amplitude to minimize the amount by which toner particles uncontrollably scattered. This attempt reduced the efficiency with which toner particles were transferred onto the recessed portions of the sheet of embossed paper. The resultant images were significantly lower in image density across the areas which corresponded to the recessed portions of the sheet of embossed paper than across the areas which did not correspond to the recessed portions. Further, in a case where an image forming apparatus such as the image forming apparatus 100 shown in FIG. 1, which outputs full-color images by placing in layers multiple monochromatic images, different in color, on the intermediary transfer belt 30, is used to form a full-color image on embossed paper, the closer to the intermediary transfer belt 30 the given monochromatic image layer among the multiple monochromatic images, the less likely to be transferred onto the recessed portions of the sheet of embossed paper. Consequently, the apparatus is likely to output images which are noticeably inaccurate in color across the areas which correspond to the recessed portions of the embossed paper.

SUMMARY OF THE INVENTION

The primary object of the present invention is to provide an image forming apparatus which is capable of highly efficiently transferring a toner image onto even the recessed portions of the surface of recording medium, and yet, does not output images which appear blurred or blotted across the areas which correspond to the recessed portions of the recording medium.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described in detail with reference to the appended drawings. The structural features of the image forming apparatuses in the following embodiments of the present invention are partially or entirely applicable to any image forming apparatus which is similar in structure to the image forming apparatuses in the following embodiments, provided that the image forming apparatus to which the structural features are applied are structured so that the AC voltage to be applied to the transfer portion to transfer a toner image onto recording medium is variable in duty ratio.

In other words, the present invention is applicable to any image forming apparatus as long as the apparatus is structured so that a toner image is transferred onto recording medium when the recording medium is conveyed through the interface between the image bearing member and transferring member of the apparatus while remaining pinched between the image bearing member and transferring member, or the interface between the intermediary transferring member and transferring member of the apparatus while remaining pinched between the intermediary transferring member and transferring member. That is, the present invention is applicable to any image forming apparatus regardless of whether the image forming apparatus is of the tandem type or not; whether the apparatus has only a single drum or no less than two; and whether the apparatus is of the intermediary transfer type or direct transfer type. In the following description of the preferred embodiments of the present invention, only the portions of the image forming apparatuses, which are involved in the formation and transfer of a toner image, will be described. However, the present invention is applicable to various image forming apparatuses, for example, printers, facsimile machines, multi-functional image forming apparatuses, etc., which are made up of the portions which will be described next, and the other mandatory devices, equipments, casing (housing), etc.

<Image Forming Apparatus>

Figure 1:
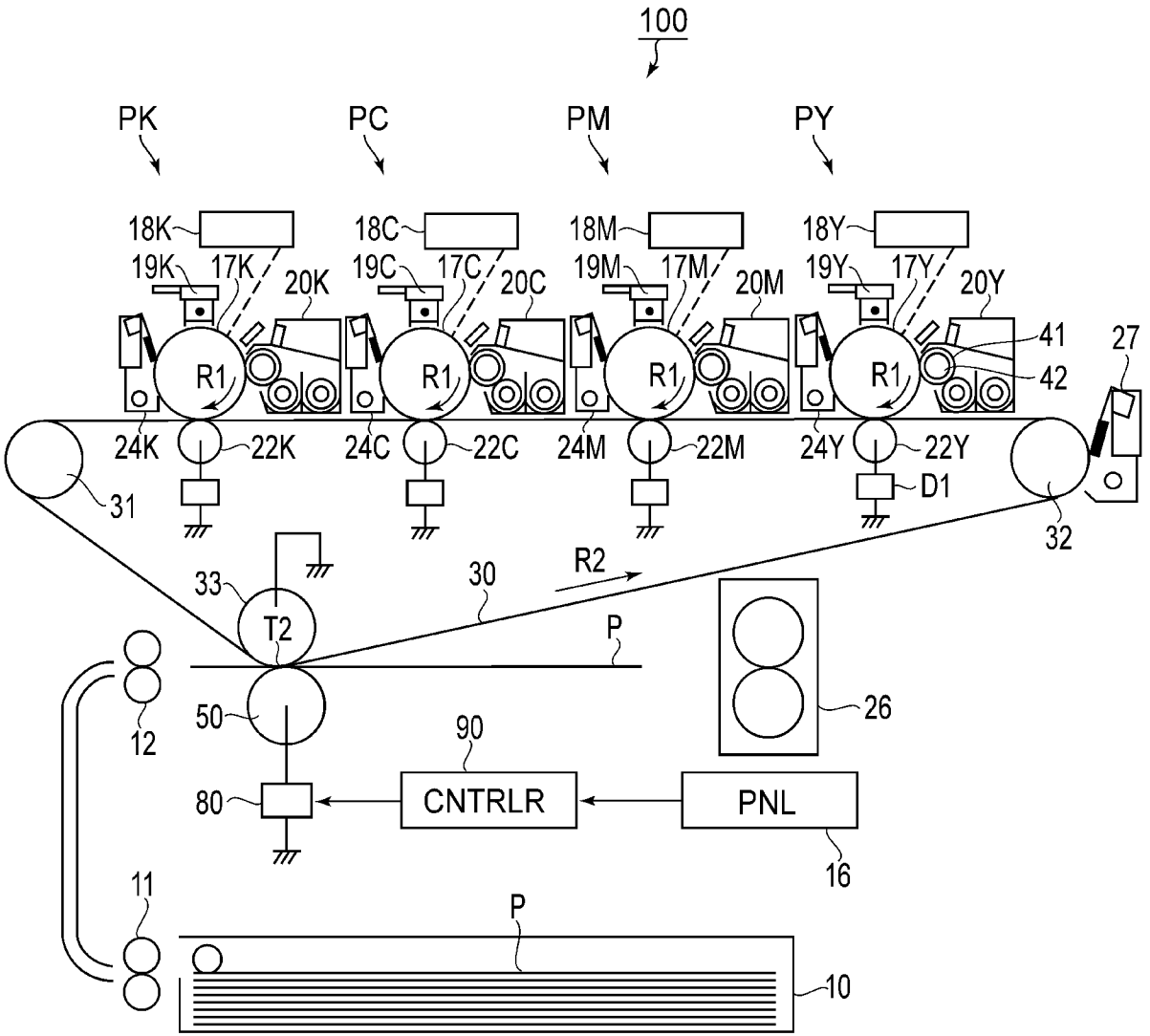
FIG. 1 is a sectional view of the image forming apparatus in the first embodiment of the present invention, and shows the structure of the apparatus.

FIG. 1 is a sectional view of a typical image forming apparatus to which the present invention is applicable. It shows the structure of the apparatus.

Referring to FIG. 1, the image forming apparatus 100 is a full-color printer of the tandem type, and also, of the intermediary transfer type. More specifically, it has image forming portions PY, PM, PC, and PK which form yellow, magenta, cyan, and black monochromatic images, respectively. The image forming portions PY, PM, PC, and PK are sequentially arranged along an intermediary transfer belt 30. The image forming apparatus 100 has a control portion 90, which makes the image forming portions PY, PM, PC, and PK form toner images on their photosensitive drums 17Y, 17M, 17C, and 17K, respectively, based on the operational settings inputted through the control panel 16 of the apparatus 100.

In the image forming portion PY, a yellow toner image is formed on the photosensitive drum 17Y, and is transferred (primary transfer) onto the intermediary transfer belt 30. In the image forming portion PM, a magenta toner image is formed on the photosensitive drum 17M, and is transferred (primary transfer) onto the yellow toner image on the intermediary transfer belt 30. In the image forming portions PC and PK, cyan and black toner images are formed on the photosensitive drums 17C and 17K, respectively, and are sequentially transferred (primary transfer) in layers onto the yellow and magenta toner images layered on the intermediary transfer belt 30.

After the transfer (primary transfer) of the four monochromatic toner images, different in color, onto the intermediary transfer belt 30, the four toner images are conveyed to a secondary transfer portion T2, in which they are transferred all at once (secondary transfer) onto a sheet of recording medium P. Then, the recording medium P and the toner images thereon are subjected to heat and pressure in a fixing apparatus 26, whereby the toner images become fixed to the surface of the recording medium P. Then, the recording medium P is discharged from the apparatus 100.

The intermediary transfer belt 30 is supported and kept stretched by a tension roller 32, a driver roller 31, and a backup roller 33 (which backs up intermediary transfer belt 30). It is circularly moved in the direction indicated by an arrow mark R2 at a process speed of 300 mm/sec, by being driven by the driver roller 31.

The recording medium P is fed into the main assembly of the image forming apparatus 100 from a recording medium cassette 10 in which multiple sheets of recording medium P are stored in layers. If two or more sheets of recording medium P are pulled out of the cassette 10, one of them is separated from the rest by a pair of separation rollers 11, and sent to a pair of registration roller 12 by the separation rollers 11. The registration rollers 12 catch the recording medium P, and keep the recording medium P on standby, while remaining stationary. Then, they send the recording medium P to the secondary transfer portion T2 with such timing that the recording medium P arrives at the secondary transfer portion T2 at the same time as the layered toner images on the intermediary transfer belt 30 arrive at the secondary transfer portion T2.

The apparatus 100 has a belt cleaning apparatus 27, which recovers the transfer residual toner, that is, the toner remaining on the intermediary transfer belt 30 after the transfer of the layered toner images on the intermediary transfer belt 30, that is, the toners in the toner images, which failed to be transferred onto the recording medium P and conveyed past the secondary transfer portion T2. More specifically, the belt cleaning apparatus 27 recovers the transfer residual toner by placing its cleaning blade in such a manner that the cleaning blade scrapes the intermediary transfer belt 30.

The image forming portions PY, PM, PC, and PK are virtually the same in structure, although they are different in the color of the toners which their developing apparatus 20Y, 20M, 20C, and 20K use in the image forming portions PY, PM, PC, and PK, respectively. Thus, only the image forming portion PY will be described. As for the description of the other image forming portions PM, PC, PK, the last letter (Y) of the structural components of the image forming portion PY shall be replaced with M, C, and K, respectively.

The image forming portion PY has a photosensitive drum 17Y. It has also a charging device 19Y of the corona type, an exposing apparatus 18Y, a developing apparatus 20Y, a primary transfer roller 22Y, and a cleaning apparatus 24Y, which are disposed in the adjacencies of the peripheral surface of the photosensitive drum 17Y in a manner to surround the photosensitive drum 17Y.

The photosensitive drum 17Y is formed of an aluminum cylinder and a photosensitive layer. The photosensitive layer is negatively chargeable, and is formed on the peripheral surface of the aluminum cylinder in a manner to entirely cover the peripheral surface of the aluminum cylinder. The photosensitive drum 17Y is rotated in the direction indicated by an arrow mark R1 at a process speed of 300 mm/sec. The charging device 19Y of the corona type uniformly and negatively changes the peripheral surface of the photosensitive drum 17Y to a preset potential level VD (pre-exposure potential level) by showering the peripheral surface of the photosensitive drum 17Y with the charged particles resulting from the corona discharge. The exposing apparatus 18Y scans the uniformly charged area of the peripheral surface of the photosensitive drum 17Y with the beam of laser light while modulating (turned on or off) the beam of laser light with the image data obtained by developing the monochromatic optical yellow image obtained by separating the full-color image to be formed, by deflecting the beam of laser light with its rotational mirror. As a given point of the charged portion (which is VD in potential level) of the peripheral surface of the photosensitive drum 17Y is exposed, it reduces in potential level to a potential level VD (post-exposure potential level). Thus, as the uniformly charged area of the peripheral surface of the photosensitive drum 17Y is exposed (scanned with beam of laser light), an electrostatic image of the monochromatic image formed of the yellow component of the full-color image to be formed is effected (written) on the peripheral surface of the photosensitive drum 17Y. The electrostatic latent image which the exposing apparatus 18Y writes on the peripheral surface of the photosensitive drum 17Y is 600 dpi (dot/inch) in resolution.

The developing apparatus 20Y contains two-component developer, which is a mixture of nonmagnetic yellow toner and magnetic carrier. It circulates the developer while stirring the developer, charging thereby the nonmagnetic toner and magnetic carrier to the negative and positive polarities, respectively. The developing apparatus 20Y has a stationary magnet 42, and a rotational development sleeve 41 fitted around the magnet 42. As the development sleeve 41 is rotated, the charged two-component developer is borne on the peripheral surface of the development sleeve 41 in a manner of cresting and rubbing the peripheral surface of the photosensitive drum 17Y. Further, an oscillatory electric voltage, that is, a combination of a negative DC voltage Vdc and an AC voltage, is applied to the development sleeve 41. The toner on the development sleeve 41 transfers onto the exposed points of the peripheral surface of the photosensitive drum 17Y, the potential level of which is VL, which is positive relative to the potential level of the development sleeve 41. In other words, the electrostatic latent image on the peripheral surface of the photosensitive drum 17Y is reversely developed.

The cleaning apparatus 24Y has a cleaning blade, which is positioned in a manner to scrape the peripheral surface of the photosensitive drum 17Y in order to recover the transfer residual toner, that is, the toner which failed to be transferred onto the intermediary transfer belt 30 and is remaining on the peripheral surface of the photosensitive drum 17Y.

<Embodiment 1>

Figure 2:
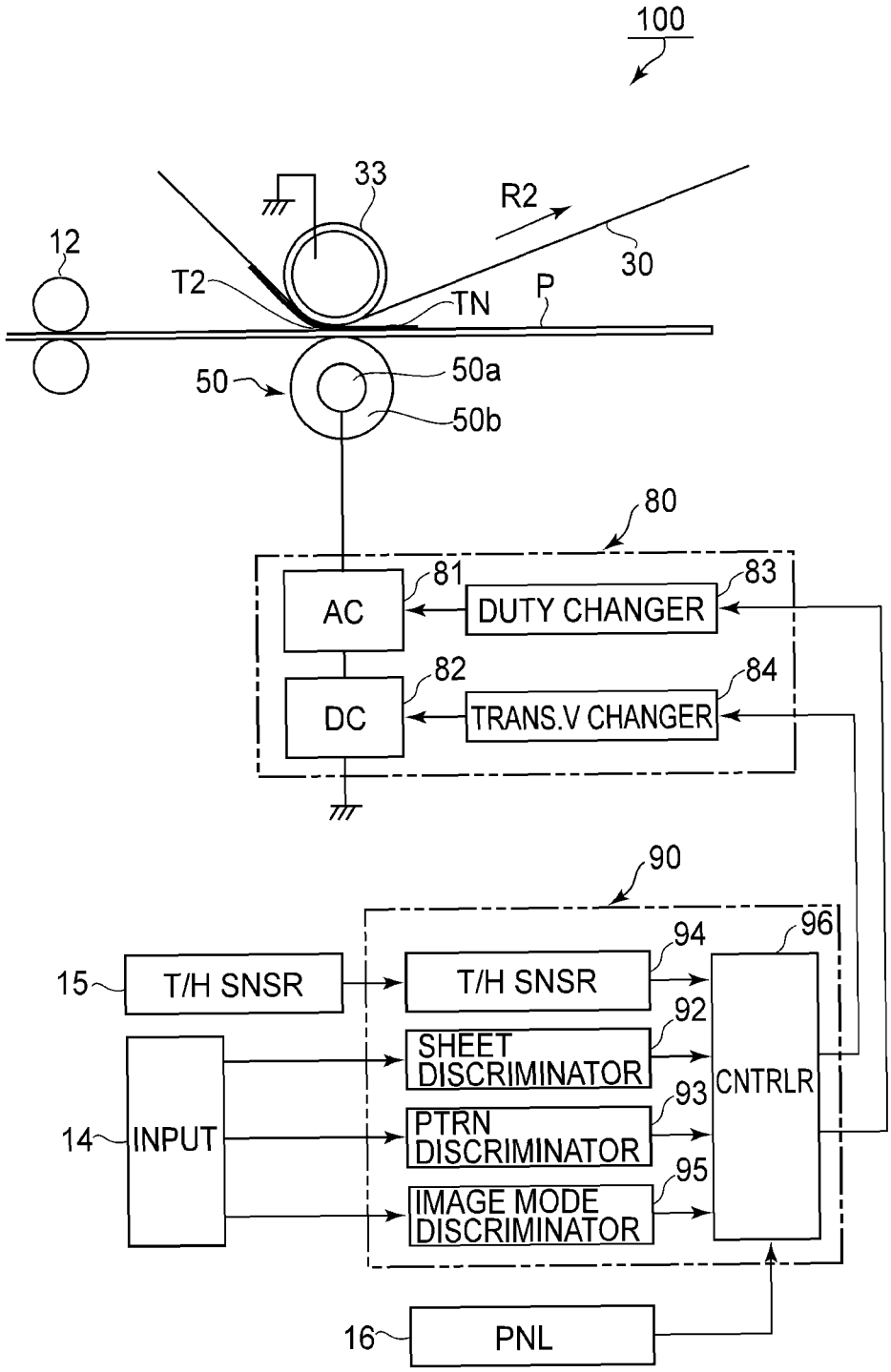
FIG. 2 is a schematic drawing of the secondary transfer portion of the image forming apparatus in the first embodiment, and shows the structure of the portion.
Figure 3:
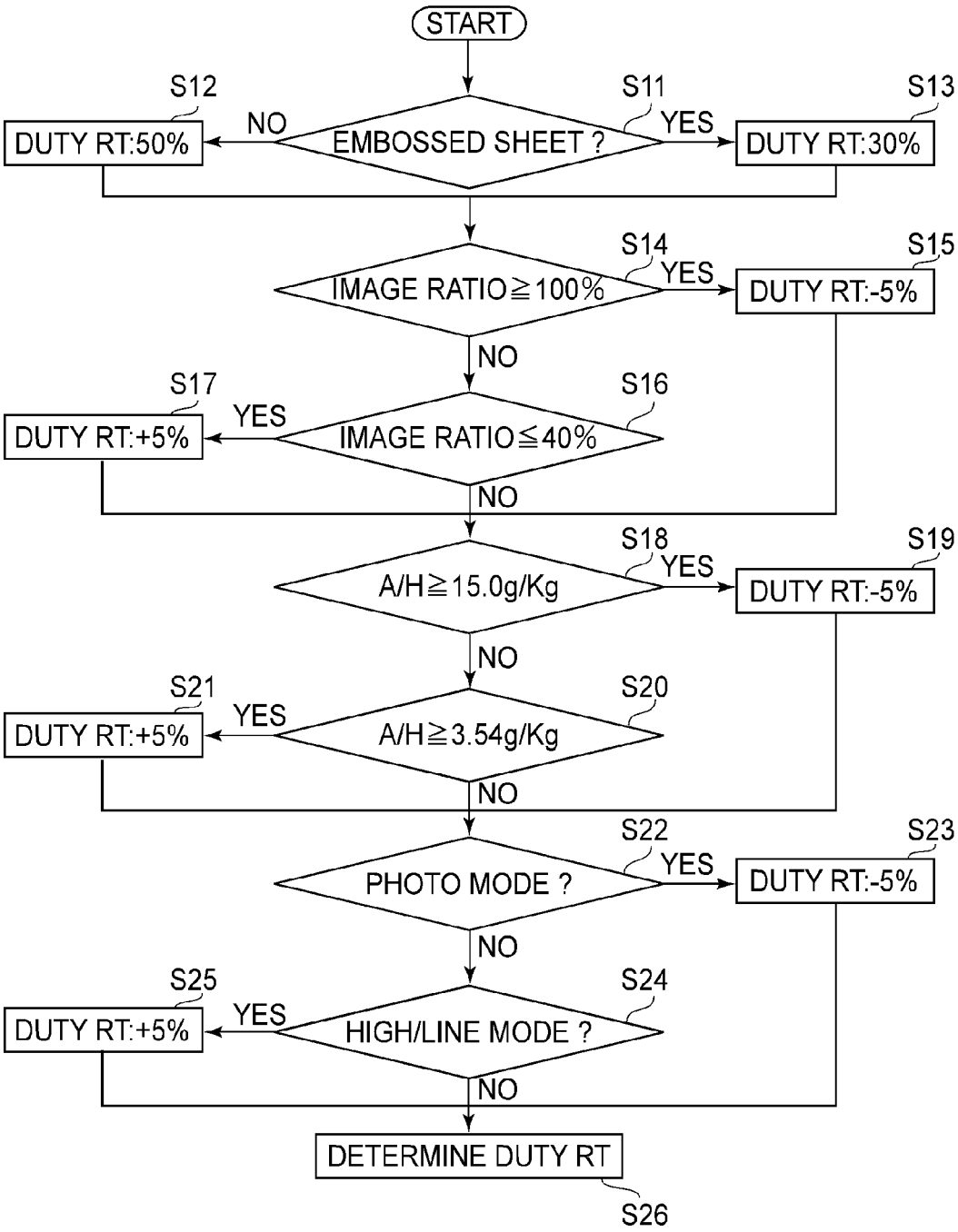
FIG. 3 is a flowchart of the transfer voltage control sequence in the first embodiment.
Figure 4:
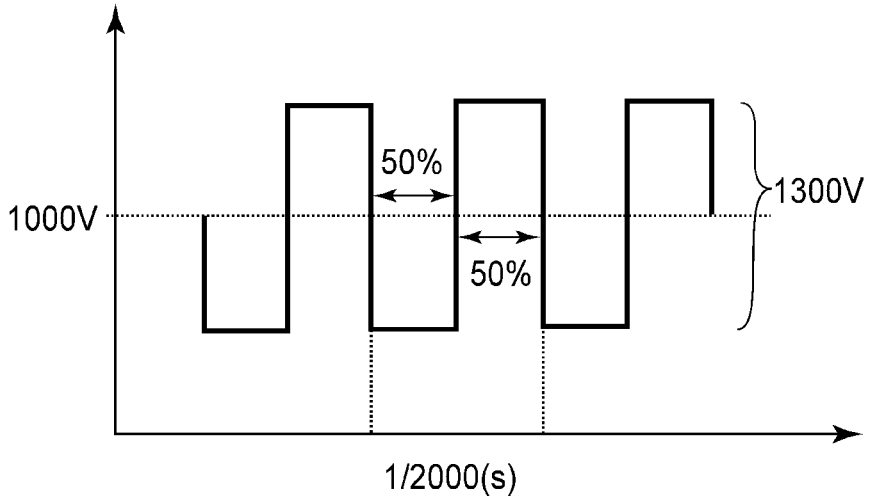
FIGS. 4(*a*) and 4(*b*) are drawings for describing the transfer voltage applied to the secondary transfer roller when ordinary paper and embossed paper, respectively, are used as recording medium.
Figure 4:
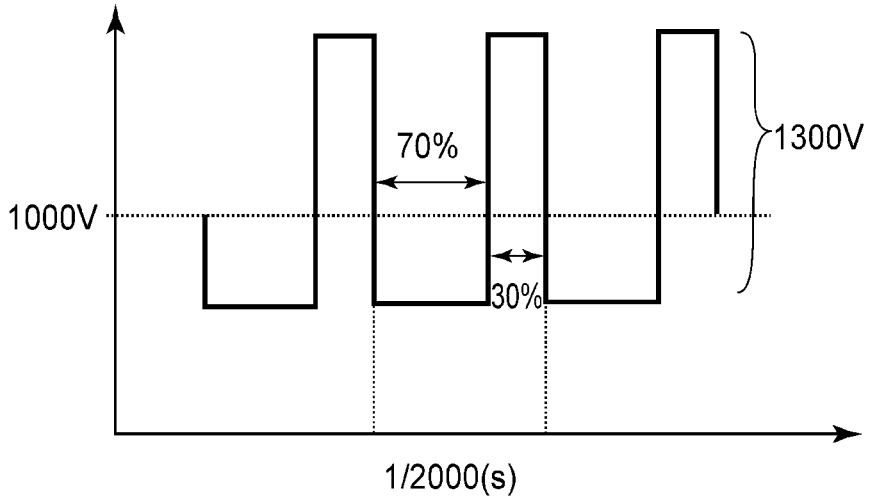
Figure 5:
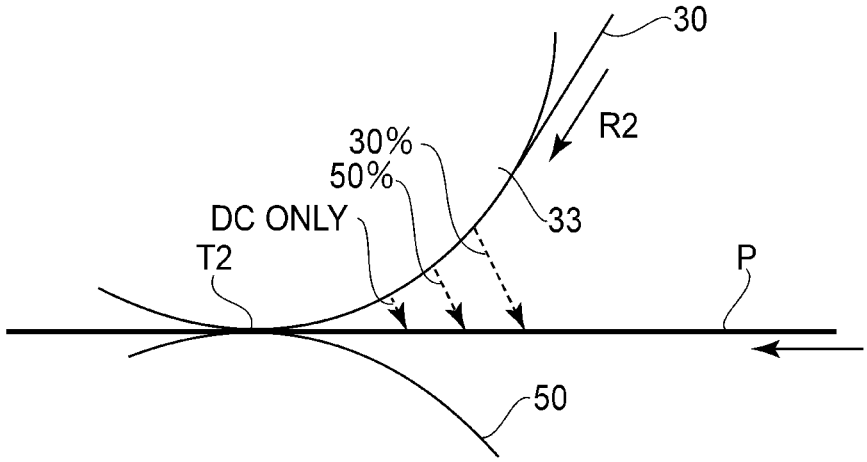
FIG. 5 is a schematic drawing of the secondary transfer portion and its adjacencies of the image forming apparatus in the first embodiment, and depicts the uncontrolled scattering of toner particles, which occurs in the adjacencies of the secondary transfer portion.
Figure 6:
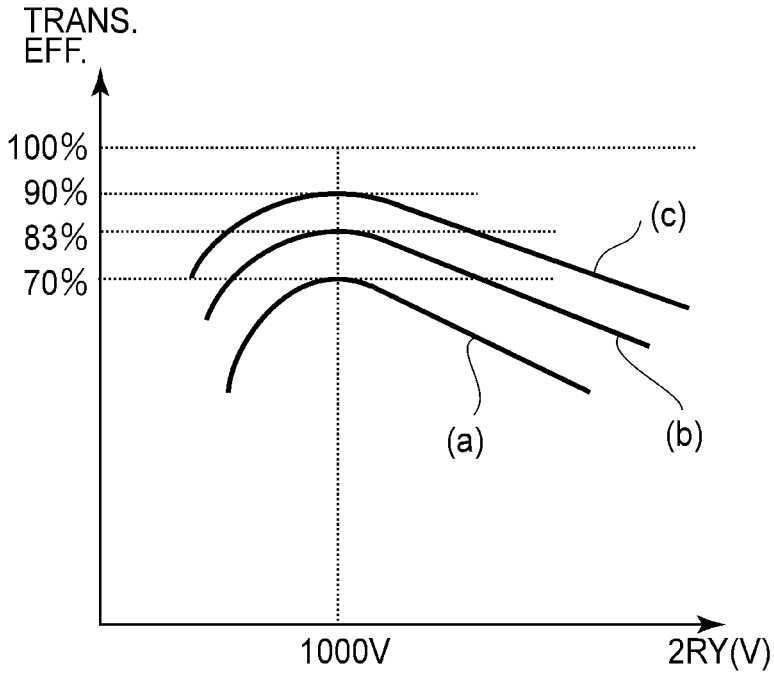
FIG. 6 is a graph which shows the relationship between the transfer efficiency and secondary transfer voltage when embossed paper is used as recording medium.

FIG. 2 is a schematic sectional drawing of the second transfer portion of the image forming apparatus in the first preferred embodiment of the present invention, and depicts the structure of the second transfer portion. FIG. 3 is a flowchart of the transfer voltage control sequence in the first embodiment. FIGS. 4(*a*) and 4(*b*) are graphs which show the relationship between the voltage applied to the development sleeve and the elapse of time when ordinary paper and embossed paper, respectively, are used as recording medium. FIG. 5 is a schematic drawing of the secondary transfer portion and its adjacencies, and depicts the unintended scattering of the toner particles in the adjacencies of the secondary transfer portion. FIG. 6 is a graph which shows the relationship between the transfer efficiency and secondary transfer voltage when embossed paper is used as recording medium.

Referring to FIG. 2, the image bearing member (30) rotates while bearing a toner image. The transferring member (5) forms the transfer portion (T2), in which the toner image on the image bearing member (30) is transferred onto recording medium P, by pinching the recording medium against the image bearing member (30). That is, the secondary transfer roller 50 forms the secondary transfer portion T2 by being pressed against the backup roller 33, with the presence of the intermediary transfer belt 30 between the two rollers 50 and 33, in such a manner that the secondary transfer roller 50 contacts the portion of the intermediary transfer belt 30, which is backed up by the backup roller 33 from the inward side of the loop it forms, being therefore arcuate. An electric power source 80 applies a positive DC voltage to the second transfer roller 50, whereby the toner image which is on the intermediary transfer belt 30 and is negative in polarity is transferred (secondary transfer) onto the recording medium P.

The intermediary transfer belt 30 is made of a resinous substance, such as polyimide, the volumetric resistivity of which was adjusted to $10^9$ [Ω·cm] by the mixing of carbon black. It is 0.1 [mm] in thickness. The secondary transfer roller 50 is 16 mm in external diameter. It is made up of a metallic core 50*a* and an elastic layer 50*b*. The metallic core 50*a* is 8 mm in external diameter. The elastic layer 50*b* is made of electrically conductive rubber sponge, and covers the peripheral surface of the metallic core 50. The secondary transfer roller 50 is kept pressed upon the backup roller 33 with the application of overall pressure of 15-50 [N]. The primary substance of which the elastic layer 50*b* is made is hypolymer elastomer, such as EPDM. The hypolymer elastomer is adjusted in electrical resistance to a medium range (10-30 [MΩ]), by the mixing of electrically conductive ionic substance. The outward surface of the elastic layer 50*b* is covered with a parting layer made of a resinous substance such as fluorinated resin.

The electric power source (80) applies a combination of a DC voltage and an AC voltage to the transfer portion (T2) to transfer the toner image on the image bearing member (30) onto the recording medium P. More specifically, the electric power source 80 applies to the secondary transfer roller 50 a combination of the DC voltage generated by a DC current source 83, and an AC voltage generated by an AC current source 81. The control portion (90), which is a controlling means, controls the electric power source (80) in such a manner that the portion of the AC current, in terms of waveform, which causes the toner particles to transfer from the intermediary transfer belt 30 onto the recording medium P, becomes no higher than 50% in duty ratio.

A duty ratio varying portion 83 modifies in waveform the voltage generated by the AC current power source 81 so that the portion of the voltage, which causes the toner images to transfer onto the recording medium P, becomes no more than 50% in duty ratio. The duty ration varying portion 83 changes in waveform the AC voltage outputted from the AC voltage power source 81, in response to the signal sent from the control circuit 96 in the control portion 90. The transfer voltage varying portion 84 sets, in voltage level, the DC voltage generated by the DC voltage power source 82, according to the type (in terms of thickness) of the recording medium P, in response to the signal sent from the control circuit 96.

For the simplification of the description of the first embodiment, it is assumed that the parameters of the AC voltage applied to the secondary transfer roller 50 other than the duty ratio (waveform) is kept unchanged regardless of the changes in the condition under which the image forming apparatus is used. That is, it is assumed that it is only in the duty ratio (waveform) that the electric power source 80 is changed. As for the electric voltage applied to the secondary transfer roller 50 during an image forming operation performed by the image forming apparatus in the first embodiment, the DC voltage is 1,000 V, and the AC voltage is rectangular in waveform, 2 kHz in frequency, and 1,300 V in amplitude (peak-to-peak voltage).

It was discovered that when the AC voltage was no higher than 1 kHz in frequency, the apparatus 100 outputted images having distinctive defects attributable to the unsatisfactory image transfer caused by the reduction in the frequency of the AC voltage. This occurred because the image forming apparatus 100 was 300 mm/sec in process speed. Therefore, the frequency of the AC voltage has to be set to a value which is no less than 1 kHz. It was also discovered that when the AC voltage was no less than 3 kHz in frequency, it was impossible for the oscillatory electric field to follow the AC component, and therefore, it was useless to modify the AC voltage in duty ratio. Thus, the frequency of the AC voltage has to be set to a value which is no more than 3 kHz. In this embodiment, therefore, the frequency of the AC voltage was set to 2 kHz, based on these experiments.

For the simplification of the description of the control for modifying the AC voltage in duty ratio in the first embodiment, it is assumed that the DC voltage is kept at 1,000 V. However, the DC voltage may be changed (optimized) in response to the changes in various factors, such as temperature and humidity of the environment in which the apparatus 100 is operated. That is, the apparatus 100 may be programmed so that it performs a program for automatically setting the DC voltage to an optimal value prior to the starting of an image forming operation.

The control circuit 96 sends to the electric power source 80 a signal which indicates the timing with which the voltage to be applied to the secondary transfer roller 50 is to be turned on or off. As the electric power source 80 receives the signal, it outputs voltage to the secondary transfer roller 50 in response to the signal.

The waveform, in terms of duty ratio, of the voltage to be applied to the secondary transfer roller 50, is modified by the control circuit 96 based on the information from a paper type identifying portion 92, an image pattern identifying portion 93, a temperature/humidity detecting portion 94, and an image formation mode identifying portion 96, which are in the control portion 90.

The paper type identifying portion 92 identifies the type of the recording medium P based on the information (instructions) which were given by a user and were transmitted from the external inputting apparatus 14. The obtained information regarding the type of the recording medium P is sent to the control circuit 96. In the first embodiment, the selection which can be made by a user about the recording medium type is between the ordinary paper and embossed paper. However, the apparatus 100 may be designed so that it can differentiate more types of paper to allow a user to make his or her choice from among three or more paper types. Further, the image forming apparatus 100 is provided with a sensor capable of detecting how rough the surface of the recording medium P is so that the control circuit 96 can identify the recording medium type based on the surface roughness of the recording medium P detected by the sensor.

The image pattern identifying portion 93 identifies the pattern of the image to be formed, based on the image signals included in the data of the print job sent from the external inputting apparatus 14, and sends the identified image pattern (information) to the control circuit 96. In the first embodiment, images are classified in terms of image pattern, based on the image ratio. However, images may be classified in image pattern, based on the number of times the beam of laser light will be turned on and off by the exposing apparatus 18Y when the photosensitive drum 17 will be exposed for the image formation.

The temperature/humidity detecting portion 94 determines the temperature and humidity of the environment in which the image forming apparatus 100 is being operated, from the output of the temperature and humidity sensor 15 disposed in the image forming apparatus 100. Then, it calculates absolute humidity [g/kgAir] of the environment from the determined temperature and humidity, and sends the calculated absolute humidity (information) to the control circuit 96.

The image formation mode identifying portion 95 identifies the image formation mode based on the instructions which are given by a user and are included in the print job data transmitted from the external inputting apparatus 14. Then, it sends the identified image formation mode (information) to the control circuit 96. In the first embodiment, it is assumed that the image forming apparatus 100 can be operated in one of three operational modes, that is, fine letter/line mode, normal image mode, and photographic mode, which are selectable by a user. However, the image forming apparatus 100 may be designed so that it can be operated in a greater number of operational modes selectable by a user.

The control circuit 96 sets the duty ratio, in terms of waveform, for the AC voltage to be applied to the secondary transfer roller 50, following the flowchart shown in FIG. 3, based on the information inputted from the paper type identifying portion 92, image pattern identifying portion 93, temperature/humidity detecting portion 94, and image formation mode identifying portion 95.

Referring to FIG. 3 along with FIG. 2, as an image forming operation is started, the control circuit 96 sets the duty ratio for the AC voltage in such a manner that the rougher the surface of the recording medium P, the smaller the portion of the AC voltage, in terms of waveform, that works in the direction to cause the toner image on the intermediary transfer belt 30 onto the recording medium P. With the employment of this control, it is ensured that not only is the portion of the AC voltage, which works in the direction to cause the toner to jump onto the recording medium P, increased, but also, the toner is transferred onto even the bottom of each recess and each groove of the embossed paper, by a satisfactory amount.

More specifically, the control portion 90 identifies the recording medium type with the use of the paper type identifying portion 92 (S11). In the case where the operational mode in which the image forming apparatus 100 is to be operated is the second image formation mode, that is, the mode in which the recording medium is embossed paper (y in S11), the control portion 90 sets duty ratio of the AC voltage to 30% (S13). However, in the case where the image forming apparatus 100 is in the first image formation mode, that is, the mode in which images are formed on ordinary paper (n in S11), the duty ratio of the AC voltage is set to 50% (S12).

Next, the control portion 96 sets the duty ratio in such a manner that the higher the image ratio, that is, the greater the amount of toner consumption per unit area of an image to be formed, the lower the duty ratio. The larger the amount of toner consumption per unit area of an image to be formed, the more likely to be noticeable the irregularities in density of the image. Therefore, when forming an image which is higher in the amount of toner consumption, the control portion 90 sets the AC voltage so that the portion of the AC voltage, which works in the direction to cause toner particles to jump from the intermediary transfer belt 30 to the recording medium P, becomes longer in duration.

More specifically, the control portion 90 detects the image ratio with the use of the image pattern identifying portion 93 (S14, S16). If the image ratio is no less than 100% (y in S14), the control portion 90 reduces the duty ratio set according to the paper type, by 5% (S15). However, if the image ratio is no more than 40%, the control portion 90 increases the duty ratio set according to the paper type, by 5% (S17).

Then, the control circuit 96 modifies the AC voltage in waveform in such a manner that the higher the humidity, the lower in duty ratio the portion of the AC voltage, which works in the direction to cause the toner to transfer from the intermediary transfer belt 30 onto the recording medium P. The higher the humidity, the smaller the amount of toner charge, and therefore, the weaker the force that causes the toner particles to jump between the intermediary transfer belt 30 and recording medium P. Therefore, the higher the humidity, the higher in duty ratio the portion of the AC voltage, which works in the direction to cause the toner to transfer from the intermediary transfer belt 30 onto the recording medium P, is made in order to ensure that the toner image on the intermediary transfer belt 30 is satisfactorily transferred onto the recording medium P.

More specifically, the control portion 90 determines the absolute humidity with the use of the temperature/humidity detecting portion 94 (S18, S20). If the absolute humidity is 15.0 [g/kgAir] (y in S18), the control portion 90 reduces the duty ratio set according to the image ratio, by 5% (S19). On the other hand, if the absolute humidity is no more than 5.54 [g/kgAir] (y in S20), the control portion 90 increases the duty ratio set according to the image ratio, by 5% (S21).

Further, when an image to be formed is a photographic image, the control portion 90 modifies the AC voltage in waveform in such a manner that the portion of the AC voltage, which works in the direction to cause the toner to transfer from the intermediary transfer belt 30 onto the recording medium P, becomes less in duty ratio than when the image to be formed is a text document. That is, when an image to be formed is a document, the irregularities of which are more noticeable than the irregularities of a photographic image, the control portion 90 prioritizes crispness over transfer efficiency, whereas when an image to be formed is a photographic image, the irregularities of which in density are more conspicuous that those of a document, the control portion 90 prioritizes transfer efficiency over the level of crispness at which images will be outputted.

More specifically, the control portion 90 identifies the image mode with the use of the image mode identifying portion 95 (S22, S24). If the image mode is the photographic mode (y in S22), the control portion 90 reduces the duty ratio set according to the absolute humidity, by 5% (S23), whereas if the image mode is the fine character/line drawing mode (y in S24), the control portion 90 increases the duty ratio set according to the absolute humidity, by 5% (S25).

FIGS. 4(*a*) and 4(*b*) show how the AC voltage is modified in waveform to set duty ratio for the AC voltage according to the information from the paper type identifying portion 92, that is, based on whether the recording medium P is ordinary paper or embossed paper, respectively.

Referring to FIG. 4(*a*), if information that the recording medium P is ordinary paper is inputted from the paper type identifying portion 92, the control circuit 96 sends to the duty ratio altering portion 83 such a signal that reduces the duty ratio of the AC voltage by 50%.

Next, referring to FIG. 4(*b*), if information that the recording medium P is embossed paper is inputted from the paper type identifying portion 92, the control circuit 96 sends to the duty ratio altering portion 83 such a signal that sets the duty ratio of the waveform of the AC voltage to 30%.

Given next is the reason why the value to which the duty ratio is set when the recording medium P is embossed paper is smaller than that when the recording medium P is ordinary paper. Table 1 given below presents comparisons, in terms of transfer efficiency and unintended scattering of toner, between when images were formed on ordinary paper by the image forming apparatus 100 and when images are formed on embossed paper by the image forming apparatus 100.

TABLE 1

| | Sheet | | | |
|---|---|---|---|---|
| | Plain Paper | | Embossed Paper | |
| Duty Ratios (%) | 50 | 30 | 50 | 30 |
| Transfer Property | Good | Excellent | Fair | Good |
| Anti-scattering | Good | Fair | Good | Fair |

For the simplification of description, Table 1 lists only two of typical recording media which are different in surface roughness. "Transfer efficiency" in Table 1 means the approximate amount by which the toner (toner image) on the intermediary transfer belt 30 was transferred onto the recording medium P. "Unintended scattering of toner" means the extent (development level) to which the image on the intermediary transfer belt 30 was disturbed as it was transferred onto the recording medium. As will be evident from Table 1, the modification, in waveform, of the AC voltage in such a manner that reduces the AC voltage in duty ratio results in worsening of the unintended scattering of toner.

Next, referring to FIG. 5, the unintended scattering of toner is attributable to the transfer electric field generated by the voltage applied to the secondary transfer roller 50. More specifically, it occurs on the immediately upstream side of the secondary transfer portion T2, in terms of the moving direction of the intermediary transfer belt 30, as the transfer voltage is applied to the secondary transfer roller 50 before the recording medium P comes into contact with the intermediary transfer belt 30. Referring to FIG. 4, if the AC voltage is relatively low in duty ratio, its portion which works in the direction to transfer the toner on the intermediary transfer belt 30 onto the recording medium P is larger than when the AC voltage is higher in duty ratio. Therefore, if the AC voltage is relative low, the toner begins to jump in an oscillatory manner between the intermediary transfer belt 30 and recording medium P at a point farther upstream from the center of the secondary transfer portion T2 in terms of the moving direction of the intermediary transfer belt 30.

Therefore, in a case where a combination of a DC voltage, and an AC voltage which is 30% in duty ratio, is applied to the secondary transfer roller 50, the distance the toner particles jump is longer than in a case where a combination of a DC voltage, and an AC voltage which is 50% in duty ratio, is applied to the secondary transfer roller 50. Thus, the former case is higher in the probability with which the toner particles will be transferred onto the unintended areas on the recording medium P than the latter case, being therefore worse in terms of the unintended scattering of toner.

Referring again to Table 1, on the other hand, when the recording medium P is embossed paper, the transfer efficiency is affected more by the changes in the duty ratio than when the recording medium P is ordinary paper. More specifically, when the AC voltage was 50% in duty ratio, the toner failed to be satisfactorily transferred onto the recesses (grooves) of the recording medium P (embossed paper). In particular, in a case where a multi-color image made up of layers of monochromatic toner images different in color is transferred, the portions of the image, which are made up of two or more layered monochromatic images which are different in color, and therefore, the color of which is the secondary color, that is, the color effected by a combination of two or more primary colors, fail to be satisfactorily transferred; it will be only the monochromatic image(s) farther from the surface of the intermediary transfer belt 30 that is transferred onto the recesses (grooves) of the recording medium P. Therefore, the corresponding portions of the image which will result on the recording medium P will be significantly different in color from the portions of the image, which will be on the areas of the recording medium P, which are adjacent to the recesses (grooves) of the recording medium P (embossed paper). Thus, when the recording medium P is embossed paper, it is appropriate to set the duty ratio of the AC voltage to 30%, which is preferable in terms of transfer efficiency.

In other words, in this embodiment, when the recording medium P is embossed paper, the duty ratio of the AC voltage is set to 30% to improve the image forming apparatus 100 in the efficiency with which the toner is transferred from the intermediary transfer belt 30 onto the recording medium P (embossed paper). The reason for the improvement is that setting the duty ratio of the AC voltage to 30% makes the toner particles on the intermediary transfer belt 30 more efficiently jump onto the recording medium P. More specifically, as the toner particles are transferred (primary transfer) onto the intermediary transfer belt 30, they are kept adhered to the surface of the intermediary transfer belt 30 by a combination of electrostatic and mechanical forces. Further, as the voltage which is applied to the secondary transfer roller 50 and is opposite in polarity to the toner polarity overwhelms the electrostatic and mechanical forces, the toner particles on the surface of the intermediary transfer belt 30 jump onto the surface of the recording medium P. Thus, modifying in waveform the AC voltage in such a manner that the portion of the AC voltage, which works in the direction to cause the toner image to transfer onto the recording medium P, is reduced in duty ratio, makes it easier for the toner particles to leave the intermediary transfer belt 30 (and jump to recording medium P), because the reduction in duty ratio makes higher in peak voltage the portion of the AC voltage, which works in the direction to cause the toner particles to transfer onto the recording medium.

Referring again to Table 1, setting the duty ratio of the AC voltage to 30% makes the image forming apparatus 100 unsatisfactory in terms of the unintended scattering of toner. However, there is little chance that characters and images made of fine lines are formed on embossed paper, which is rough in surface texture. Thus, even if characters and images made of fine lines are transferred onto embossed paper, without unreasonable amount of unintended scattering of toner, the fine characters and fine lines are substantially distorted by the peaks and valleys of the surface of the recording medium P, and therefore, are difficult to read and/or recognize. Therefore, there is little reason why a user should select the setting which is better in terms of the reduction in the unintended scattering of toner. Therefore, it is appropriate to set the duty ratio of the AC voltage to 30%, which is preferable in terms of transfer efficiency, when the recording medium P is embossed paper.

FIG. 6 presents the results of the comparisons in transfer efficiency among image forming operations in which embossed paper was used as recording medium P, and which are different in the voltage applied to the secondary transfer roller 50. More specifically, a line (a) in FIG. 6 represents the operation in which only a DC voltage was applied to the secondary transfer roller 50, and a line (b) represents the operation in which a combination of a DC voltage, and an AC voltage which was 50% in duty ratio, was applied to the secondary transfer roller 50. A line (c) represents the operation in which a combination of a DC voltage, and an AC voltage which was 30% in duty ratio, was applied to the secondary transfer roller 50. Further, the DC voltage was changed in three operations to find out how the changes in the DC voltage affect the transfer efficiency. Here, "transfer efficiency" means the ratio of the amount of the toner transferred from the toner image on the intermediary transfer belt 30 onto the recording medium P relative to the amount (1.2 mg/cm$^2$: assumed maximum amount of toner on area of toner image, whose color is secondary color) of the toner which was in the toner image on the intermediary transfer belt 30 before the transfer of the toner image onto the recording medium P.

Referring to FIG. 6, in the operation (a) in which it was only a DC voltage that was applied to the secondary transfer roller 50, the transfer efficiency with which the toner was transferred onto a sheet of embossed paper was insufficient; the maximum transfer efficiency was 70%. In comparison, in the operation (b) in which a combination of a DC voltage, and an AC voltage which was 50% in duty ratio, was applied to the secondary transfer roller 50, the maximum transfer efficiency at which the toner was transferred onto a sheet of embossed paper was 83%. Further, in the operation (c) in which a combination of a DC voltage, and an AC voltage which was 30% in duty ratio, was applied to the secondary transfer roller 50, the maximum transfer efficiency at which the toner image was transferred onto a sheet of embossed paper, was 90%.

In the operation (a) in which only a DC voltage was applied to the secondary transfer roller 50, the toner began to retransfer in the adjacencies of the recesses (grooves) of the embossed paper before the toner began to jump from the intermediary transfer belt 30 to the recesses (grooves) of the surface of the recording medium P (embossed paper). This is thought to be why the transfer efficiency is relatively low in the operation (a). "Retransfer of toner" means a phenomenon that because the voltage is too strong, the toner having transferred onto the recording medium P returns to the intermediary transfer belt 30. More specifically, it is the phenomenon that if the DC voltage applied to the secondary transfer portion T2 was too high, the toner having been transferred onto the recording medium P is reversed in polarity, and therefore, returns to the intermediary transfer belt 30. The toner retransfer is attributable to the reversal charging of the toner. Thus, it is significantly affected by the value of the DC voltage, that is, the mean for the integrals of the voltage applied to the secondary transfer roller 50. The mean for the integrals of the voltage that causes the toner retransfer remains roughly the same in value regardless of the duty ratio.

It is reasonable to think that in the operation (b) in which the combination of a DC voltage, and an AC voltage which was 50% in duty ratio, was applied to the secondary transfer roller 50, before the retransfer of the toner from the adjacencies of the grooves began, a certain amount of the toner had begun to jump into the grooves of the recording medium P (embossed paper), increasing thereby the transfer efficiency.

The application of the AC voltage, in addition to the DC voltage, to the secondary transfer roller 50 momentarily makes the combination of the AC and DC voltages momentarily very high, whereby the toner is momentarily pulled way from the intermediary transfer belt 30. Therefore, in the operation (b), more toner was made to jump to the recording medium P than in the operation case (a) in which only the DC voltage was applied.

In the operation (c) in which the combination of a DC voltage, and an AC voltage which was 30% in duty ratio, was applied to the secondary transfer roller 50, the combination momentarily became even higher than in the operation (b) in which a DC voltage, and an AC voltage which was 50% in duty ratio, were applied to the secondary transfer roller 50. Thus, it is reasonable to think that in the operation (c), more toner was momentarily pulled away from the intermediary transfer belt 30 and transferred onto the recording medium P than in the operation (b). It is also reasonable to think that in the operation (c), the portion of the AC voltage, which works in the opposite direction from the direction in which the toner is moved onto the recording medium, was smaller in value, and therefore, the toner having transferred onto the recording medium P was not pulled back onto the intermediary transfer belt 30.

Next, comparing in terms of transfer efficiency the operation (c) in which a combination of a DC voltage, and an AC voltage (1,300 V in amplitude) which was 30% in duty ratio, was applied to the secondary transfer roller 50, and the operation (b) in which a combination of the DC voltage, and an Ac voltage (1,800 V in amplitude) which was 50% in duty ratio, was applied to the secondary transfer roller 50, the two operations (b) and (c) were made different in the amplitude of the AC voltage in such a manner that they became the same in the portion of the AC voltage, which works in the direction to cause the toner to transfer onto the recording medium P.

The comparison revealed that even though the operation (b) in which the AC voltage was 50% in duty ratio and the operation (c) in which the AC voltage was 30% in duty ratio were the same in the portion of the AC voltage, which worked in the direction to transfer the toner onto the recording medium P, the operation (b) was not as good in transfer efficiency as the operation (c), although the two operations were the same in terms of the unintended scattering of toner. The inventors of the present invention think that the causes of these results are as follows: In the operation (b) in which the AC voltage was 50% in duty ratio, a certain amount of toner was pulled away from the intermediary transfer belt 30 by the momentary high voltage, but most of the toner pulled away from the intermediary transfer belt 30 is pulled back to the intermediary transfer belt 30. In the operation (c) in which the AC voltage was 30% in duty ratio, the portion of the AC voltage, which worked in the opposite direction from the direction in which the toner was transferred onto the recording medium P was 900 V in amplitude, which was substantially larger than that (400 V) in the operation (b) in which the AC voltage was 30% in duty ratio. As described above, in this embodiment, the image forming apparatus 100 was optimized in secondary transfer performance by optimizing in duty ratio the AC voltage of the secondary transfer voltage according to paper type. Also in this embodiment, in the case where the recording medium was embossed paper which is substantially rough in surface texture, the duty ratio of the AC voltage was set to a value which is no less than 10% and no more than 50%.

Table 2 shows how the duty ratio is set for the AC voltage for the secondary transfer voltage based on the information from the image pattern identifying portion (93 in FIG. 2).

TABLE 2

| Image Ratio (four colors) | ~40% | 40~100% | 100%~ |
|---|---|---|---|
| Duty Ratio (%) | 5 | 0 | −5 |

Referring to FIG. 2, in the first embodiment, in a case where the sum of the image ratios of all the monochromatic images of which a single full-color image is made is no less than 100%, the AC voltage was modified in waveform to change the AC voltage in duty ratio by −5%, whereas in a case where it is no less than 40% and no more than 100%, the AC voltage is not altered in duty ratio. Further, in a case where the sum of the image ratios of all the monochromatic images of which a single full-color image is made is no more than 40%, the duty ratio is altered by +5%.

Sum of image ratios of all monochromatic images=image ratio of Y monochromatic image+image ratio of M monochromatic image+image ratio of C monochromatic image+K monochromatic image.

The following is the reason why the AC voltage is altered in duty ratio according to the image pattern (image ratio). That is, the greater the amount of toner (per unit area: $mg/cm^2$) on the intermediary transfer belt 30, the worse the efficiency (transfer efficiency) with which the toner is transferred from the intermediary transfer belt 30 onto the recording medium P. Further, generally speaking, an image which is relatively high in image ratio is larger in the area where multiple monochromatic toner images, different in color, overlap, being therefore greater in the amount of the toner of which it is made. Therefore, when an image which is relatively high in image ratio is transferred, the image forming apparatus 100 is lower in transfer efficiency than when an image which is relatively low in image ratio is transferred. Also generally speaking, such an image as a photographic image and a graphic image that is relatively high in image ratio is more likely to be required to be more accurate in color than in crispness. Therefore, when forming an image which is relatively high in image ratio, it is preferred that the portion of the AC voltage, which works in the direction to cause the toner to transfer from the intermediary transfer belt 30 onto the recording medium P, is altered by −5% in duty ratio, in order to increase the image forming apparatus 100 in transfer efficiency, knowing that such alteration makes the apparatus 100 slightly worse in terms of the minimization of the unintended scattering of toner.

In comparison, an image which is low in image ratio is smaller in the amount of toner per unit area, being therefore advantageous in terms of transfer efficiency. Generally speaking, however, an image which is low in image ratio is such an image that is made up of characters, fine lines, etc., being therefore desired to be crisp in appearance. Therefore, when forming an image which is low in image ratio, the AC voltage is desired to be altered by +5% in order to prioritize the concern with the unintended scattering of toner, even if the alteration may sacrifice transfer efficiency.

As described above, by optimizing in duty ratio the AC voltage to be applied to the secondary transfer roller 50 according to image pattern, it is possible to optimize the image forming apparatus 100 in secondary transfer performance, for an image to be outputted.

Table 3 shows how the AC voltage to be applied to the secondary transfer roller 50 is set in duty ratio, based on the information from the temperature/humidity detecting portion (94 in FIG. 2).

TABLE 3

| Abs. Humidity | ~3.54 | 3.54~15.0 | 15.0~ |
|---|---|---|---|
| Duty Ratio (%) | 5 | 0 | −5 |

Referring to Table 3, in the first embodiment, when the absolute humidity calculated from the temperature and humidity within the housing of the image forming apparatus 100 is no less than 15.0 [g/kgAir], the AC voltage is altered in duty ratio by −5%, whereas when it is in a range of 3.54-15.0 [g/kgAir], the AC voltage is not altered in duty ratio. Further, when the absolute humidity is no more than 3.54 [g/kgAir], the AC voltage is altered in duty ratio by +5%.

The reason why the AC voltage is altered in duty ratio according to the absolute humidity of the ambience of the image forming apparatus 100 is as follows. The efficiency with which a toner image is transferred from the intermediary transfer belt 30 onto the recording medium P is significantly affected by the absolute humidity of the ambient air of the image forming apparatus 100.

When the image forming apparatus 100 is operated in an environment which is high in humidity, more specifically, in absolute humidity, toner is smaller in the amount (Q/M) of charge, and therefore, is low in transfer efficiency. However, when the toner is smaller in the amount (Q/M) of charge, it is less likely to scatter. Therefore, when the image forming apparatus 100 is operated in a high humidity environment, it is desired for the portion of the AC voltage, which works in the direction to make the toner to transfer onto the recording medium, is altered by −5% in duty ratio to improve the apparatus 100 in transfer efficiency.

On the other hand, when the image forming apparatus 100 is used in an ambience which is relatively low in absolute humidity, toner is greater in the amount (Q/M) of electric charge, and therefore, is better in terms of transfer efficiency. However, as toner increases in the amount (Q/M) of electric charge, it is more likely to uncontrollably scatter. Therefore, when the apparatus 100 is used in a low humidity environment, the portion of the AC voltage, which works in the direction to cause the toner onto the recording medium P, is desired to be altered in duty ratio by +5% to minimize the unintended scattering of toner.

As described above, the image forming apparatus 100 can be optimized in the secondary transfer performance, by optimizing in duty ratio the AC voltage to be applied to the secondary transfer roller 50 according to the absolute humidity of the ambient air of the apparatus 100.

Table 4 shows how the duty ratio of the AC voltage to be applied to the secondary transfer roller 50 is set based on the information from the image mode identifying portion (95 in FIG. 2).

TABLE 4

| | Image Forming Mode | | |
|---|---|---|---|
| | Fine Character/Line Drawing Mode | Normal Mode | Photo Mode |
| Duty Ratio (%) | 5 | 0 | −5 |

Referring to Table 4, in the first embodiment, when the image mode was the fine character/line drawing mode, the AC voltage was altered in duty ratio by +5%, whereas when the image mode was the ordinary image mode, the AC voltage was not altered in duty ratio. Further, when the image mode was the photographic mode, the AC voltage was altered in duty ratio by −5%.

The reason why the AC voltage was altered in duty ratio according to image mode is as follows. In a case where a user selected the photographic mode, the images which would be outputted by the image forming apparatus 100 would be photographic or graphic images, and therefore, the image forming apparatus 100 was desired to be more accurate in color. Thus, it was desired that the AC voltage was altered in duty ratio by −5% to improve the apparatus 100 in transfer efficiency, knowingly that such an alteration was likely to slightly increase the apparatus 100 in the amount by which toner would be unintendedly scattered.

In comparison, when the operational mode selected by a user was the fine character/line drawing mode, the images which would be outputted were documents and/or line drawings. Therefore, the user was more concerned with the crispness in appearance than accuracy in color. Therefore, the AC voltage was desired to be altered by +5% in duty ratio, in order to minimize the amount by which toner is unintendedly scattered, knowing that such an alteration makes the apparatus 100 slightly reduce in transfer efficiency.

As described above, in this embodiment, the image forming apparatus 100 was optimized in secondary transfer performance, by optimizing in duty ratio the AC voltage to be applied to the secondary transfer roller 50, based on the operational mode of the apparatus 100, in order to optimize the apparatus 100 in secondary transfer performance according to the type of images to be outputted.

Also as described above, in the first embodiment, the AC voltage was optimized in duty ratio according to the paper type, image pattern, ambience, image mode. Therefore, the image forming apparatus 100 was optimized in the secondary transfer performance for each of the abovementioned factors.

<Embodiment 2>

Figure 7:
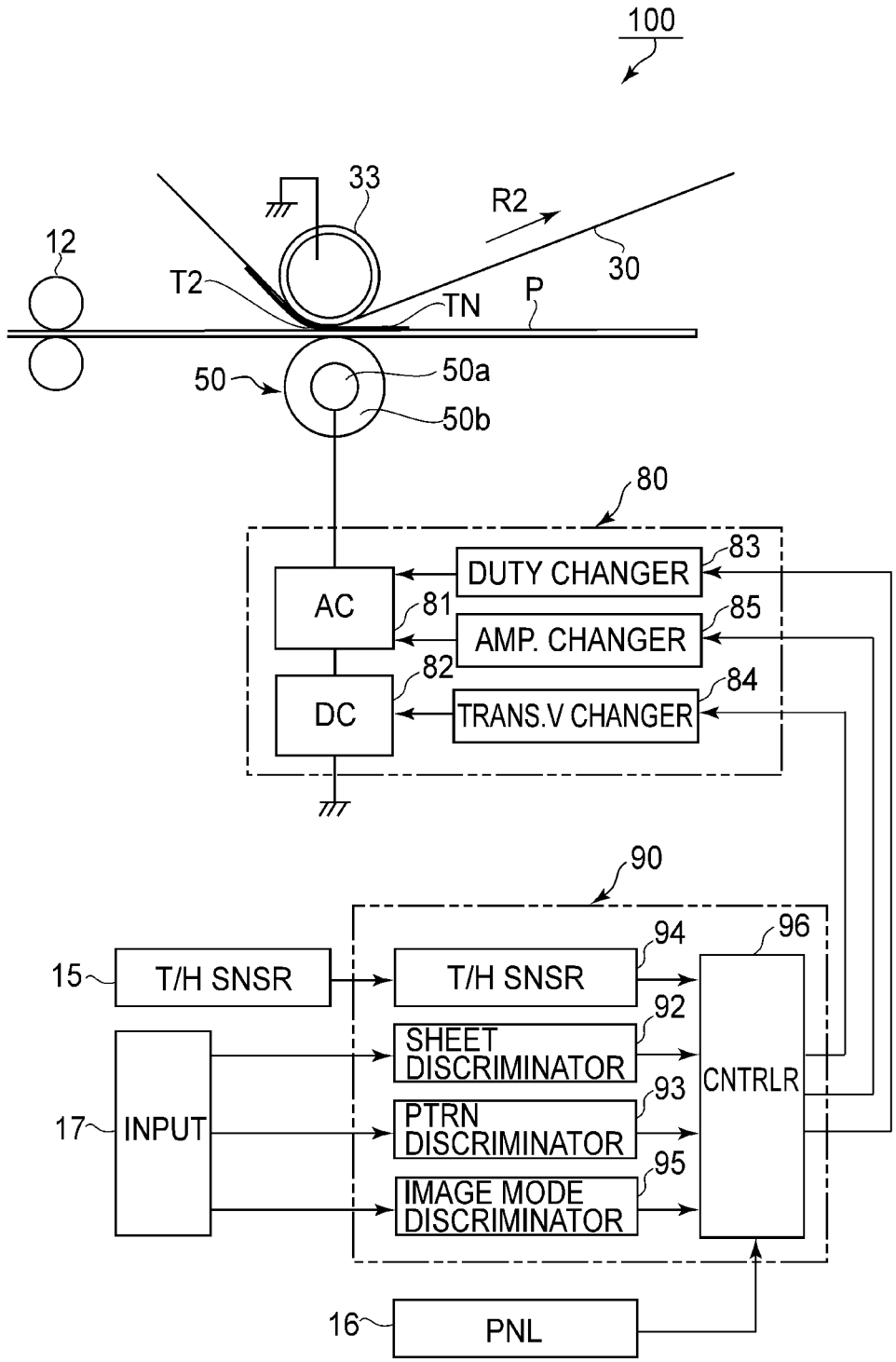
FIG. 7 is a schematic drawing of the secondary transfer portion of the image forming apparatus in the second embodiment of the present invention, and shows the structure of the portion.
Figure 8:
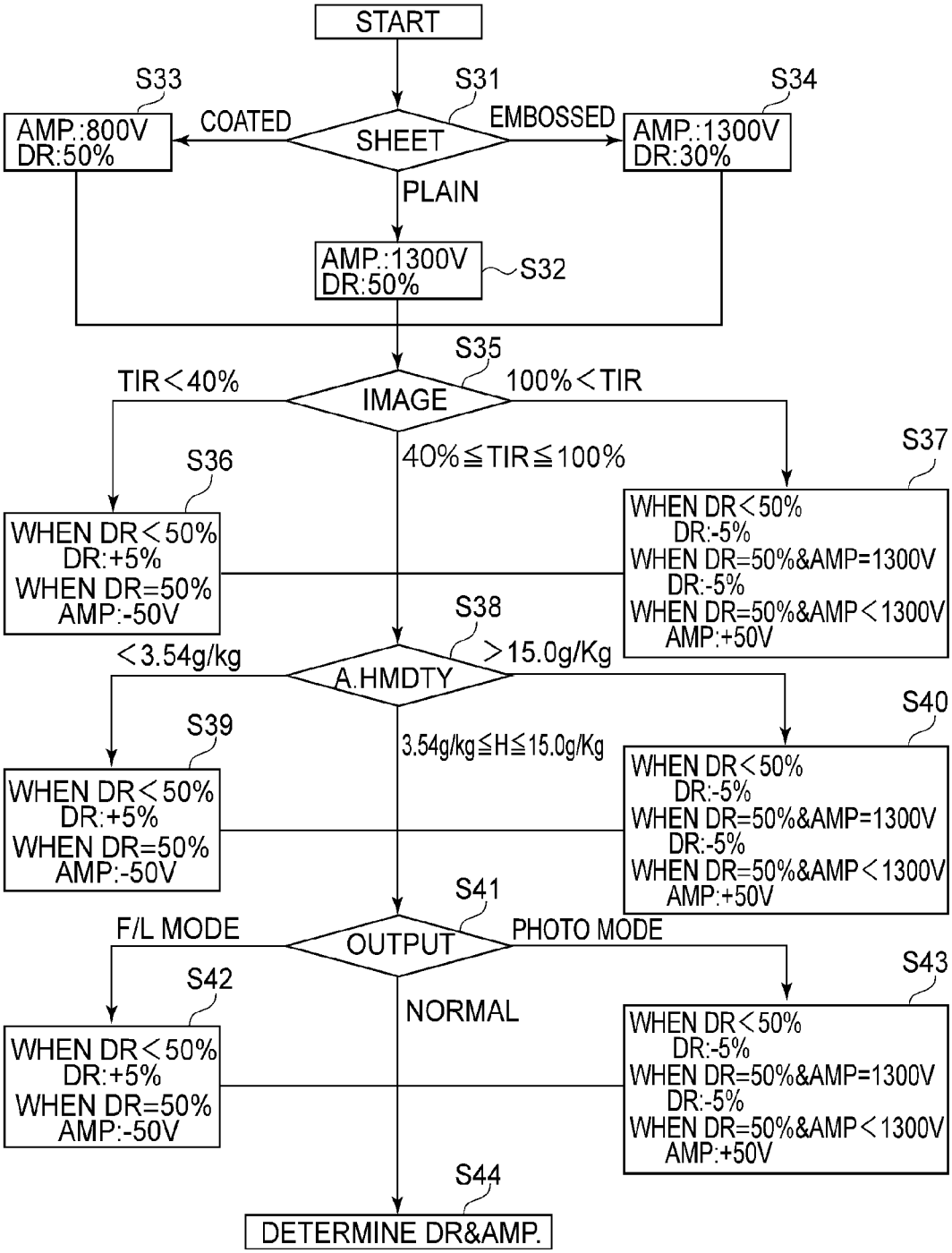
FIG. 8 is a flowchart of the transfer voltage control sequence in the second embodiment.
Figure 9:
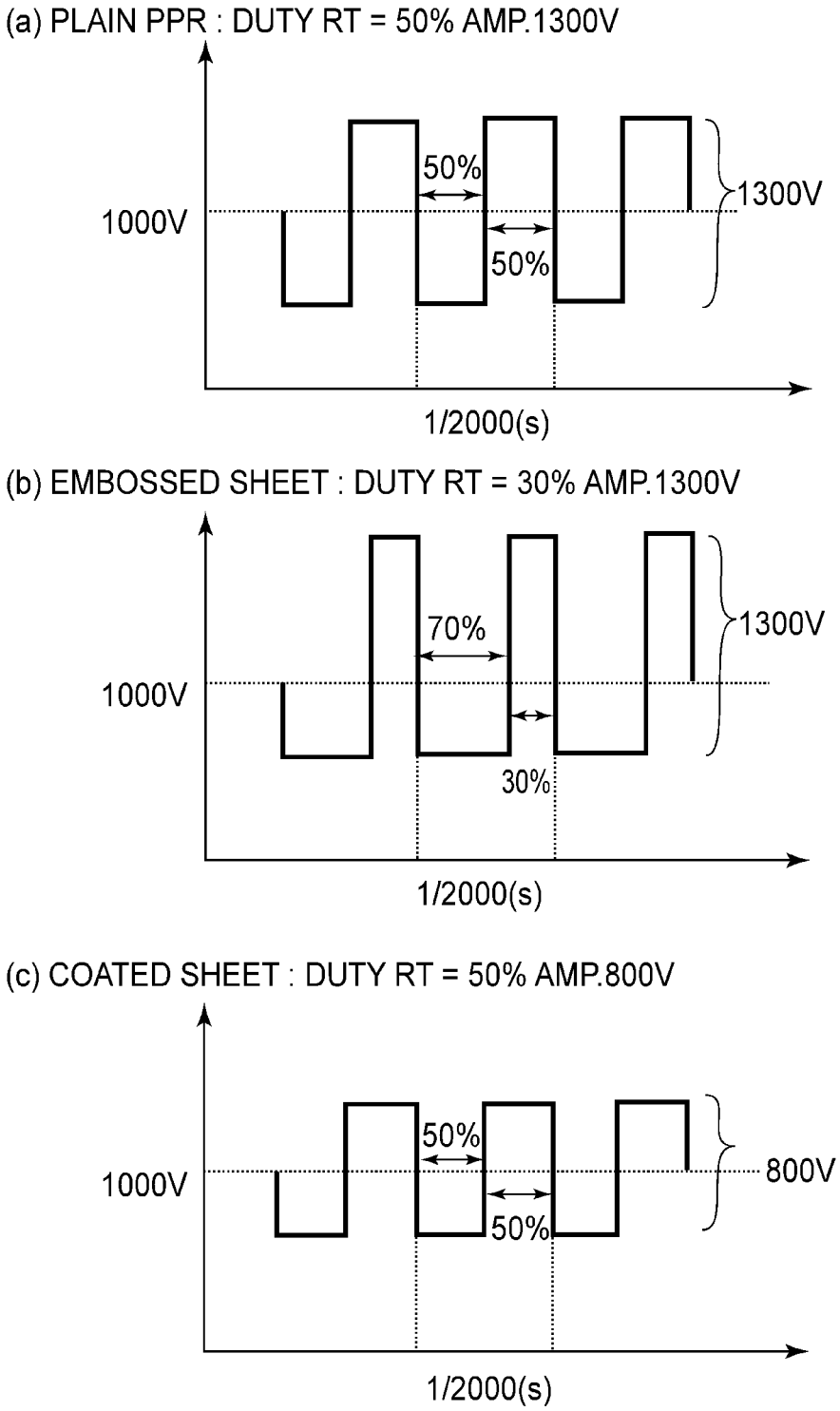
FIGS. 9(*a*), 9(*b*) and 9(*c*) are drawings for describing the transfer voltage applied to the secondary transfer roller when ordinary paper, embossed paper, and coated paper, respectively, are used as recording medium.

FIG. 7 is a drawing for describing the structure of the secondary transfer portion in the second preferred embodiment. FIG. 8 is a flowchart of the transfer voltage control sequence in the second embodiment. FIG. 9 is a drawing for describing the transfer voltage to be applied to the second transfer roller in the second embodiment.

Referring to FIG. 7, the second embodiment is virtually the same in structure as the first embodiment, except that in the second embodiment, the electric power source 80 for supplying the secondary transfer portion T2 with the secondary transfer voltage is provided with an amplitude altering portion 85. Thus, the members, components, etc., in FIG. 7, which are the same in structure as the counterparts in the first embodiment, are given the same referential codes as those given as those given to the counterparts, one for one, shown in FIGS. 1 and 2, and will not be described here.

The AC voltage power source 81 of the electric power source 80 outputs an AC voltage, the amplitude of which is set by the amplitude altering portion 85 according to the duty ratio set by the duty ratio altering portion 81. It is in response to the signal sent from the control circuit 96 that the amplitude altering portion 85 alters in amplitude the AC voltage outputted from the AC voltage power source 81. In the second embodiment, among the parameters of the electric voltage to be applied to the secondary transfer roller 50, those other than the duty ratio and amplitude are kept as set regardless of the changes in the image formation condition.

In the second embodiment, among the parameters of the AC voltage applied by the electric power source 80, it is only the duty ratio and amplitude of the AC voltage that are altered. The DC voltage to be applied to the secondary transfer roller 50 in the second embodiment is 1,000 V, which is the same as that in the first embodiment, and the AC voltage to be applied to the secondary transfer roller 50 in the second embodiment is 2 kHz in frequency, which is the same as that in the first embodiment.

The control circuit 96 sends to the electric power source 80 a signal for turning on the voltage to be supplied to the second transfer roller 50, with the same timing as that with which the leading edge of the recording medium P arrives at the second transfer portion T2. Then, it sends to the power source 80 a signal for turning off the voltage to be applied to the secondary transfer roller 50, with the same timing as that with which the trailing edge of the recording medium P comes out of the secondary transfer portion T2. The power source 80 outputs the electric voltage to the secondary transfer roller 50 in response to the signal sent from the control circuit 96.

The paper type identifying portion 92 selects one of the three paper types, more specifically, "ordinary paper", "coated paper", and "embossed papers", based on the instruction given by a user and the like information. Then, it sends this information to the control circuit 96. The image pattern identifying portion 93 identifies the pattern of the image to be formed, based on the image ratio of the image to be outputted, and sends the identified image pattern (information) to the control circuit 96. The temperature/humidity detecting portion 94 determines the absolute amount of moisture of the internal air of the image forming apparatus 100, and sends this information (absolute humidity) to the control circuit 96. The image mode identifying portion 95 identifies the image mode based on the instructions given by a user, etc., from among three modes, that is, fine character/line drawing mode, ordinary image mode, and photographic mode, and sends this information to the control circuit 96.

The control circuit 96 controls the image forming apparatus 100, following the flowchart shown in FIG. 8, based on the information inputted from the paper type identifying portion 92, image pattern identifying portion 93, temperature/humidity detecting portion 94, and image mode identifying portion 95, whereby the control circuit 96 determines the amplitude and duty ratio (waveform) for the AC voltage to be applied to the secondary transfer roller 50.

Referring to FIG. 8 along with FIG. 7, the control circuit 96 varies the AC voltage in peak-to-peak voltage in such a manner that the portion of the AC voltage, which works in the direction to cause the toner to return to the image bearing member (30) exceeds a preset value (upper limit). This control is executed because if the portion of the AC voltage, which works in the direction to cause the toner to return to the image bearing member (30) exceeds the preset upper limit value, the image forming apparatus 100 worsens in the unintended scattering of toner.

More specifically, as an image forming operation is started, the control portion 90 identifies the recording medium type with the use of the paper type identifying portion 92 (S31). When the recording medium P is ordinary paper, the control portion 90 sets the amplitude of the AC voltage to 1,300 V, and duty ratio of the AC voltage to 30% (S32). However, when the recording medium P is embossed paper, it sets the amplitude and duty ratio of the AC voltage to 1,300 V and 30%, respectively (S34). Further, when the recording medium P is coated paper, it sets the amplitude and duty ratio of the AC voltage to 800 V and 50%, respectively (S33).

Next, the control portion 90 detects the image ratio with the use of the image pattern identifying portion 93 (S35). When the image ratio is no more than 40%, and the duty ratio set according to the paper type is no more than 50%, the control portion 90 increases the duty ratio by 5%, whereas when the image ratio is no more than 40% and the duty ratio set according to the paper type is 50%, the control portion 90 reduces the amplitude by 50 V (S36).

On the other hand, when the image ratio is no less than 100% and the duty ratio set according to the paper type is no more than 50%, the control portion 90 reduces the duty ratio by 5%. The control portion 90 reduces the duty ratio by 5% also when the duty ratio is 50% and the amplitude is 1,300 V. However, when the duty ratio set according to the paper type is 50%, and the amplitude is no more than 1,300 V, the control portion 90 increases the amplitude by 50% (S37).

Next, the control portion 90 determines the absolute amount of moisture with the use of the temperature/humidity detecting portion 94 (S38). When the absolute amount of moisture is no more than 3.5 [g/kgAir] (y in S18) and the duty ratio set according to the image ratio is no more than 50%, the control portion 90 increases the duty ratio by 5%. However, when the absolute amount of moisture is no more than 3.5 [g/kgAir] (y in S18) and the duty ratio set according to the image ratio is 50%, the control portion 90 decreases the amplitude by 50 V (S39).

On the other hand, when the absolute amount of moisture is no less more than 15.0 [g/kgAir] and the duty ratio set according to the image ratio is no more than 50%, the control portion 90 decreases the duty ratio by 5%. Also when the absolute amount of moisture is no less more than 15.0 [g/kgAir]; the duty ratio set according to the image ratio is 50%; and the amplitude is 1,300 V, the control portion 90 reduces the duty ratio by 5%. However, when the absolute amount of moisture is no less than 15.0 [g/kgAir]; the duty ratio set according to the image ratio is 50%; and the amplitude is no more than 1,300 V, the control portion 90 increases the amplitude by 50 V (S40).

Next, the control portion 90 determines the image mode with use of the image mode identifying portion 90 (S41). When the image mode is the fine character/line drawing mode and the duty ratio set according to the absolute humidity is no more than 50%, the control portion 90 increases the duty ratio by 5%. However, when the image mode is the fine character/line drawing mode and the duty ratio set according to the absolute humidity is 50%, the control portion 90 decreases the amplitude by 50 V (S42).

On the other hand, when the image mode is the photographic mode and the duty ratio set according to the absolute humidity is no more than 50%, the control portion 90 decreases the duty ratio by 5%. Also when the image mode is the photographic mode; the duty ratio set according to the absolute humidity is 50%; and the amplitude is 1,300 V, the control portion 90 decreases the duty ratio by 5%. However, when the image mode is the photographic mode; the duty ratio set according to the absolute humidity is 50%; and the amplitude is no more than 1,300 V, the control portion 90 increases the amplitude by 50 V (S43).

FIGS. 9(*a*), 9(*b*), and 9(*c*) show how the duty ratio (waveform) is determined for the AC voltage based on the information from the paper type identifying portion 92.

Referring to FIG. 9(*a*), when the information inputted from the paper type identifying portion 92 indicates that the recording medium P is ordinary paper, the control circuit 96 sends to the amplitude altering portion 85 such a signal that sets the amplitude of the AC voltage to 1,300 V. Further, it sends to the duty ratio altering portion 83 such a signal that sets the duty ratio of the AC voltage to 50%.

Next, referring to FIG. 9(*b*), when the information inputted from the paper type identifying portion 92 indicates that the recording medium P is embossed paper, the control circuit 96 sends to the amplitude altering portion 85 such a signal that sets the amplitude of the AC voltage to 1,300 V. Further, it sends to the duty ratio altering portion 83 such a signal that sets the duty ratio of the AC voltage to 30%.

Next, referring to FIG. 9(*c*), when the information inputted from the paper type identifying portion 92 indicates that the recording medium P is coated paper, the control circuit 96 sends to the amplitude altering portion 85 such a signal that sets the amplitude of the AC voltage to 800 V. Further, it sends to the duty ratio altering portion 83 such a signal that sets the duty ratio of the AC voltage to 50%.

The reason why the AC voltage is reduced in amplitude when the recording medium P is coated paper is as follows. Incidentally, the reason why the AC voltage is reduced in duty ratio when the recording medium P is embossed paper is the same as that in the first embodiment, and therefore, will not be described here. Table 5 shows the results of the evaluation, in terms of transfer efficiency and unintended scattering of toner, of the images formed on coated paper and ordinary paper by the image forming apparatus 100 under various conditions which were different in the amplitude and duty ratio of the AC voltage.

TABLE 5

| | Sheet | | | | | | | |
|---|---|---|---|---|---|---|---|---|
| | Coated Paper | | | | Plain paper | | | |
| | Amp. (V) | | | | | | | |
| | 800 | | 1300 | | 800 | | 1300 | |
| Duty Ratio (%) | 50 | 30 | 50 | 30 | 50 | 30 | 50 | 30 |
| Transfer Property | E | E | E | E | F | G | G | E |
| Anti-scattering | E | G | G | F | E | G | G | F |

E: Excellent
G: Good
F: Fair

For the simplification of description, Table 5 lists only two of typical recording media. It was confirmed as shown in Table 5 that when the recording medium P was coated paper, the image forming apparatus 100 remained excellent in transfer efficiency even when the AC voltage was reduced in amplitude to 800 V while it was kept at 50% in the duty ratio, which was the same that when the recording medium P was ordinary paper. Further, as the apparatus 100 was reduced in the amplitude of the AC voltage, the apparatus 100 improved in terms of the minimization of the unintended scattering of toner than when the amplitude was 1,300 V, because as the apparatus 100 was reduced in the amplitude, it reduced in the maximum value of the portion of the AC voltage, which worked in the direction to cause the toner image to transfer onto the recording medium P.

Further, in order to confirm the effect of the reduction in the amplitude of the AC voltage, experiments were carried out in which the amplitude of the AC voltage was kept at 1,300 V, and the secondary transfer voltage was increased in duty ratio to 70%, that is, it was modified in waveform so that the portion of the AC voltage, which worked in the direction to cause the toner image to transfer onto the recording medium P became 70% in duty ratio, because this combination of amplitude (1,300 V) and duty ratio (70%) was equivalent to the AC voltage, which was 800 V in the amplitude of the portion of the AC voltage, which works in the direction to cause the toner image onto the recording medium, and is 70% in duty ratio. Thus, this combination improved the image forming apparatus 100 in terms of the minimization of the unintended scattering of toner, but reduced the apparatus 100 in transfer efficiency.

The reason for these results is that the portion of the AC voltage, which worked in the opposite direction from the direction to cause the toner image onto the recording medium P, became 900 V, and therefore, more toner particles were pulled back onto the intermediary transfer belt 30, as described above regarding the first embodiment. Further, the reason why the reduction in amplitude of the AC voltage improved the image forming apparatus 100 in terms of the minimization of the unintended scattering of toner is that the smaller the amplitude, the lower in the maximum value the portion of the AC voltage, which works in the direction to cause the toner image onto the recording medium P, and therefore, the smaller the amount by which the toner particles unintendedly jump on the immediately upstream side of the secondary transfer portion T2.

As described above, in this embodiment, the image forming apparatus 100 was optimized in terms of secondary transfer performance regardless of paper type, by optimizing the AC voltage in duty ratio and amplitude according to paper type.

Table 6 shows how the duty ratio for the secondary transfer voltage was set based on the information from the image pattern identifying portion (92 in FIG. 7).

TABLE 6

| Image Ratio (Four colors) | ~40% | 40%~100% | 100%~ |
|---|---|---|---|
| Duty Ratio (%) | 5 | 0 | −5 |
| Amp. (V) | −50 | 0 | +50 |

Referring to Table 6, in the second embodiment, when the sum of the image ratios of all the monochromatic images of which a single full-color image to be made is no less than 100%, either the AC voltage is modified in waveform so that its duty ratio is changed by −5%, or its amplitude is changed by +50 V, whereas when the sum of the image ratios of all the monochromatic images of which a single full-color image to be made is no less than 40% and no more than 100%, the AC voltage is modified in neither duty ratio nor amplitude. Further, when the sum of the image ratios of all the monochromatic images of which a single full-color image to be made is no less than 40%, either the AC voltage is modified in duty ratio by +5%, or in amplitude by −50 V. The reason why the AC voltage is changed in duty ratio or amplitude is the same as that given in the description of the first embodiment.

The selection regarding whether the AC voltage should be modified in duty ratio or amplitude is made as follows. That is, when the sum of the image ratios is no less than 100%, and the duty ratio is no more than 50%, the AC voltage is modified in duty ratio by −5%. However, when the sum of the image ratios is no less than 100%, and the duty ratio is 50%, the AC voltage is modified in amplitude by +50 V. Further, when the sum of the image ratios is no more than 40% and the duty ratio is no more than 50%, the AC voltage is modified in duty ratio by +5%. Further, when the sum of the image ratios is no more than 40% and the duty ratio is no more than 50%, the AC voltage is modified in duty ratio by +5%. However, when the sum of the image ratios is no more than 40%, and the duty ratio is 50%, the AC voltage is modified in amplitude by −50 V.

This means that the smallest value to which the portion of the AC voltage, which works in the direction to cause the toner image to transfer onto the recording medium P, is set to 650 V, which is the same as the smallest value to which the it is set when the AC voltage is 1,300 V in amplitude, and 50% in duty ratio. Further, when the portion of the AC voltage, which is opposite in direction to the direction in which the toner image is transferred onto the recording medium P, is no higher than 650 V, the AC voltage is adjusted in amplitude, whereas when it is no more than 650 V, the AC voltage is adjusted in duty ratio, in order to optimize in the maximum value the portion of the AC voltage, which works in the direction to cause the toner image to transfer onto the recording medium P.

Table 7 shows how the secondary transfer voltage is set in duty ratio and amplitude based on the information from the temperature/humidity detecting portion 94, in addition to how the secondary transfer voltage is optimized in duty ratio according to the above described paper type and image pattern.

That is, Table 7 shows how the AC voltage to be applied to the secondary transfer roller 50 is modified in waveform to optimize the AC voltage in duty ratio, based on the information from the temperature/humidity detecting portion (94 in FIG. 7).

TABLE 7

| Abs. Humidity | ~3.54 | 3.54~15.0 | 15.0~ |
|---|---|---|---|
| Duty Ratio (%) | 5 | 0 | −5 |
| Amp. (V) | −50 | 0 | +50 |

Referring to Table 7, in the second embodiment, when the absolute amount of moisture of the internal air of the image forming apparatus 100 is no less than 15.0 [g/kgAir], the AC voltage is adjusted in either duty ratio by −5%, or amplitude by +50 V, whereas when the absolute amount of moisture is in a range of 3.54-15.0 [g/kgAir], the AC voltage is not adjusted in either duty ratio or amplitude. Further, when the absolute amount of moisture is no more than 3.54 [g/kgAir], the AC voltage is adjusted in duty ratio by +5%, or in amplitude by −50 V. The reason why the AC voltage is adjusted in duty ratio or amplitude according to the absolute amount of moisture is the same as that given in the description of the first embodiment.

The selection regarding whether the AC voltage is to be adjusted in duty ratio or amplitude is made as follows. That is, when the absolute amount of moisture is no less than 15.0 [g/kgAir], and the AC voltage is no more than 50% in duty ratio, the AC voltage is adjusted in duty ratio by −5%, whereas when the absolute amount of moisture is no less than 15.0 [g/kgAir], and the AC voltage is 50% in duty ratio, the AC voltage is adjusted in amplitude by +50 V. However, when the absolute amount of moisture is no more than of 3.54 [g/kgAir] and the AC voltage is no more than 50% in duty ratio, the AC voltage is adjusted in duty ratio by +50%, whereas when the absolute amount of moisture is no more than 3.54 [g/kgAir], and the AC voltage is 50% in duty ratio, the AC voltage is adjusted in amplitude by −50 V.

With the employment of this control, the portion of the AC voltage, which is opposite in direction to the direction in which the toner image is transferred onto the recording medium P, remains no less than 650 V, as it was by the control based on image ratio. When the portion of the AC voltage, which is opposite in direction to direction in which the toner image is transferred onto the recording medium P, is no more than 650 V, the AC voltage is adjusted in amplitude, whereas when it is no less than 650 V, the AC voltage is adjusted in duty ratio, in order to optimize in maximum value the portion of the AC voltage, which works in the direction to cause the toner image to transfer onto the recording medium P.

Table 8 shows how the AC voltage to be applied to the secondary transfer roller 50 is optimized in duty ratio by modifying the AC voltage in waveform, based on the information from the image mode identifying portion (95 in FIG. 7).

TABLE 8

| | Image Forming Mode | | |
|---|---|---|---|
| | Fine Character/Line Drawing Mode | Normal Mode | Photo Mode |
| Duty Ratio (%) | 5 | 0 | −5 |
| Amp. (V) | −50 | 0 | +500 |

Referring to FIG. 8, in the second embodiment, when the image mode is the fine character/line drawing mode, the AC voltage is adjusted in duty ratio by +5%, or in amplitude by +50 V. On the other hand, when the image mode is the ordinary mode, the AC voltage is not adjusted in either duty ratio or amplitude. Further, the image mode is the photographic mode, the AC voltage is adjusted in duty ratio by −5%, or in amplitude by −50 V. The reason why the AC voltage is adjusted in duty ratio or amplitude based on the image mode is the same as that given in the description of the first embodiment.

The selection regarding whether the AC voltage is to be adjusted in duty ratio or amplitude is made as flows. That is, when the image mode is the fine character/line drawing mode and the AC voltage is no more than 50% in duty ratio, the AC voltage is adjusted in duty ratio by −5%. However, when the image mode is the fine character/line drawing mode and the AC voltage is 50% in duty ratio, the AC voltage is adjusted in amplitude by +50 V. Further, when the image mode is the photographic mode and the AC voltage is no more than 50% in duty ratio, the AC voltage is adjusted in duty ratio by +5%. However, when the image mode is the photographic mode and the AC voltage is 50% in duty ratio, the AC voltage is adjusted in amplitude by −50 V.

With the employment of this adjustment, the bottom value for the portion of the AC voltage, which is opposite in direction to the direction in which the toner image is transferred onto the recording medium P, is set to 650 V. When this portion of the AC voltage is no more than 650 V, the AC voltage is adjusted in amplitude, where as this voltage is no less than 650 V, the AC voltage is adjusted in duty ratio, in order to optimize in maximum value the image forming apparatus 100 in the portion of the AC voltage, which works in the direction to cause the toner image to transfer onto the recording medium P.

As described above, in this embodiment, the secondary transfer voltage was optimized in duty ratio and amplitude according to the paper type, image pattern, absolute amount of moisture, and image output mode. Therefore, the image forming apparatus 100 was optimized in secondary transfer performance according to various conditions under which it was operated. The AC voltage to be applied to the secondary transfer roller 50 was set in duty ratio and amplitude, based on the information inputted from the paper type identifying portion 92, image pattern identifying portion 93, temperature/humidity detecting portion 94, and image mode identifying portion 95. Therefore, the image forming apparatus 100 was optimized in the secondary transfer performance regardless of the conditions under which it is used. Further, a bottom value was set for the portion of the AC voltage, which is opposite in direction to the portion of the AC voltage which works in the direction to cause the toner image to transfer onto the recording medium P. Therefore, the amount by which toner particles are pulled back onto the intermediary transfer belt 30 was minimized, whereby the image forming apparatus 100 remains stable in transfer efficiency.

<Embodiment 3>

Figure 10:
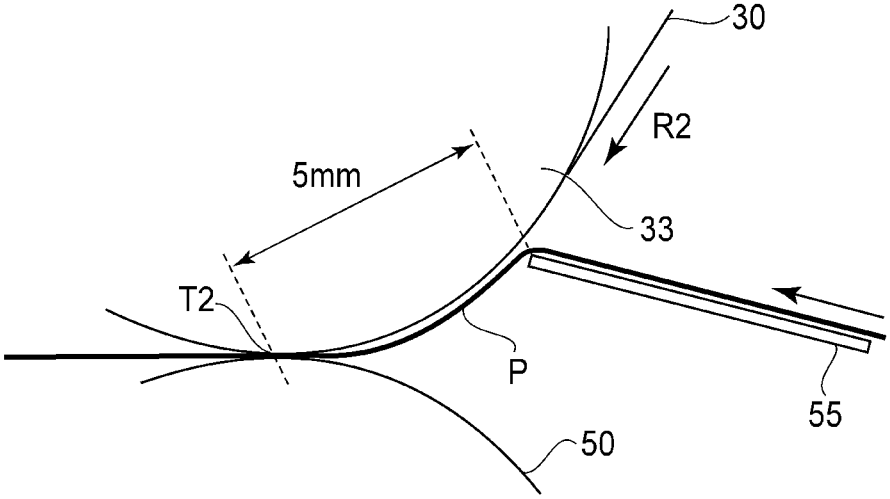
FIG. 10 is a schematic drawing of the secondary transfer portion and its adjacencies of the image forming apparatus in the third embodiment.

FIG. 10 is a schematic drawing of the secondary transfer portion and its adjacencies of the image forming apparatus in the third embodiment, and depicts their structures.

Referring to FIG. 10, in the third embodiment, the image forming apparatus 100 is provided a recording medium guiding mechanism (55), which is on the immediately upstream side of the secondary transfer portion T2. Otherwise, this image forming apparatus 100 is the same in structure and control as that in the first embodiment. Therefore, the structural members in FIG. 10, which are the same as the counterparts in the first embodiment, which are shown in FIGS. 1 and 2, are given the same referential codes as those given to the counterparts in FIGS. 1 and 2, and will not be described here.

The parameters of the voltage to be applied to the secondary transfer roller 50 in this embodiment are the same as those in the first embodiment. That is, the voltage is a combination of a DC voltage which is 1,000 V in magnitude, and an AC voltage which is 1,300 V in amplitude (peak-to-peak voltage), and 2 kHz in frequency. The duty ratio for the AC voltage is set according to various combinations among the paper type, image pattern, absolute amount of moisture, and image mode, following the same procedures as those in the first embodiment, and using the same constants as those used in the first embodiment.

In the third embodiment, the image forming apparatus 100 is provided with a recording medium guiding mechanism (55), which is on the immediately on the upstream side of the transfer portion (T2) in terms of the rotational direction of the photosensitive drum 17. The guiding mechanism 55 guides the recording medium P to make the recording medium P begin to adhere to the image bearing member (30) with the presence of no gap between the intermediary transfer belt and recording medium P, at such a point that when the combination of the DC voltage, and the portion of the AC voltage, which works in the direction to cause the toner image to transfer medium onto the recording medium P, is applied to the transfer portion (T2), the toner particles do not jump away from the image bearing member (30).

More concretely, the secondary transfer portion T2 is formed by pressing the secondary transfer roller 50, which is 20 mm in external diameter, upon the intermediary transfer belt 30, across the area of the intermediary transfer belt 30, which is backed up by the backup roller 33 from the inward side of the loop which the belt 30 forms, and therefore, is curved by the backup roller 33. The backup roller 33 is 20 mm in external diameter. The recording medium guiding member 55 is disposed so that its guiding edge is positioned 5 mm upstream of the secondary transfer portion T2. Therefore, as the recording medium P is conveyed toward the secondary transfer portion T2, it is placed in contact with the intermediary transfer belt 30 at a point which is 5 mm upstream of the secondary transfer portion T2. Then, while the recording medium P is conveyed from the point of contact with the intermediary transfer belt 30 to the secondary transfer portion T2, it is kept in contact with the intermediary transfer belt 30 with the presence of no gap between the recording medium P and intermediary transfer belt 30.

Referring to FIG. 5, it became evident that when it is only a DC voltage (1,000 V) that is applied to the secondary transfer roller 50 of the image forming apparatus 100, the unintended scattering of toner does not occur in the area which is no less than 2 mm upstream of the secondary transfer portion T2. It also became evident that in the case of the AC voltage control in the first embodiment, when the secondary transfer voltage was the combination of the DC voltage (1,000 V), and the AC voltage which is 1,300 V in amplitude, and the AC voltage is 50 V in duty ratio in waveform, toner particles did not jump on the upstream side of the secondary transfer portion T2 as long as the distance between the point of contact between the recording medium P and intermediary transfer belt 30 and the secondary transfer portion T2 was no less than 4 mm. Further, it became evident that when the AC voltage was 50% in duty ratio, the toner particles on the intermediary transfer belt 30 did not jump on the upstream side of the secondary transfer portion T2 as long as the distance from the secondary transfer portion T2 is no less than 5 mm.

That is, in the case of the AC voltage control in the first embodiment, when the recording medium P was embossed paper, the image forming apparatus 100 was improved in transfer performance by adjusting the apparatus 100 in the duty ratio of the AC voltage. However, the apparatus 100 became worse in terms of the minimization of the unintended scattering of toner. Referring to FIG. 5, in the third embodiment, the image forming apparatus 100 was reduced in the distance which the toner particles on the image bearing member have to jump between the image bearing member and recording medium, on the upstream side of the secondary transfer portion T2. Therefore, the apparatus 100 was reduced in the unintended scattering of toner, which is attributable to the jumping of toner particles. Therefore, the side effects of the optimization of the image forming apparatus 100 in duty ratio were minimized.

According to the present invention, the image forming apparatus 100 is modified in the waveform of the AC voltage applied to the secondary transfer roller 50 so that the portion of the AC voltage, which works in the direction to cause the toner on the image bearing member to transfer onto the recording medium P remains no more than 50% in duty ratio. Therefore, the portion of the AC voltage per oscillatory cycle, which works in the direction to cause the toner on the image bearing member to transfer onto the recording medium P is larger than the portion of the AC voltage, which works, per oscillatory cycle of the AC voltage, in the direction to pull the toner on the recording medium P back onto the image bearing member. Therefore, the present invention makes it possible to reduce in strength the electric field that works in the direction to pull the toner on the recording medium P back onto the image bearing member, without reducing in strength the electric field that works in the direction to cause the toner on the image bearing member to transfer onto the recording medium P. Therefore, the image forming apparatus 100 increases in the ratio with which the toner particles which have just been transferred onto the recording medium P, and the toner particles which are in flight on their way to be transferred onto the recording medium P, settle in the recesses (grooves) of the surface of the recording medium P. Therefore, it reduces in the amount by which toner particles move back and forth through the gap between image bearing member and recording medium P. Therefore, it reduces in size the area where the toner particles in a toner image are unintendedly scattered when the portions of the toner image, which correspond in position to the recesses (grooves) of the recording medium P, are transferred onto the recording medium P.

In other words, the present invention makes it possible to transfer a toner image onto even the recesses (grooves) of recording medium, at a high level of transfer efficiency. Therefore, it can provide an image forming apparatus which can output prints, the image on which does not appear blurred or blotted, even when recording medium surface is rough like that of embossed paper.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 154463/2009 filed Jun. 30, 2009 which is hereby incorporated by reference.

What is claimed is:

1. An image forming apparatus comprising:

a rotatable image bearing member configured to bear a toner image;

a transfer member constituting a transfer portion configured to transfer the toner image formed on said image bearing member onto a recording material;

a voltage source configured to apply, to said transfer member, a voltage in the form of superimposed DC voltage and AC voltage;

a controller configured to control said voltage source to change a high-absolute-value-voltage side duty ratio of the AC voltage in accordance with a kind of the recording material, in a range less than 50%; and an executing portion configured to execute an operation in an image forming mode in which the toner image is transferred from said image bearing member onto the recording material with the high-absolute-value-voltage side duty ratio controlled by said controller.

2. An apparatus according to claim 1, wherein said controller sets the high-absolute-value-voltage side duty ratio which decreases with increase of a surface roughness of the recording material.

3. An apparatus according to claim 1, further comprising a humidity detecting member for detecting a humidity, and said controller sets the high-absolute-value-voltage side duty ratio which decreases with increase of the humidity detected by said humidity detecting member.

4. An apparatus according to claim 1, wherein said controller sets the high-absolute-value-voltage side duty ratio which decreases with increase of an image ratio per unit area.

5. An apparatus according to claim 1, wherein said controller controls a peak-to-peak voltage of the AC voltage such that a voltage value of a low-absolute-value-voltage side is not less than a predetermined value.

6. An apparatus according to claim 1, wherein said controller controls said voltage source such that the high-absolute-value-voltage side duty ratio is not less than 10%.

7. An image forming apparatus comprising:

a rotatable image bearing member configured to bear a toner image;

a transfer member constituting a transfer portion configured to transfer the toner image formed on said image bearing member onto a recording material;

a voltage source configured to apply, to said transfer member, a voltage in the form of superimposed DC voltage and AC voltage having a predetermined frequency;

a controller configured to control said voltage source to change a duty ratio of the AC voltage, on condition that the DC voltage, a peak-to-peak voltage of the AC voltage, the frequency of the AC voltage, and a time-integral of the voltage applied by said voltage source are not changed, in accordance with a kind of the recording material; and an executing portion configured to execute an operation by said controller in a first image forming mode in which the toner image is transferred from the image bearing member onto a first recording material with a first high-absolute-value-voltage side duty ratio, and in a second image forming mode in which the toner image is transferred from the image bearing member onto a second recording material having a larger surface roughness than that of the first recording material, with a second high-absolute-value-voltage side duty ratio which is smaller than the first high-absolute-value-voltage side duty ratio.

8. An apparatus according to claim 7, wherein the second high-absolute-value-voltage side duty ratio is less than 50%.

9. An apparatus according to claim 8, wherein the second high-absolute-value-voltage side duty ratio is not less than 10%.

10. An apparatus according to claim 7, further comprising a humidity detecting member configured to detect a humidity, wherein said controller sets at least one of the first and second high-absolute-value-voltage side duty ratios which decreases with increase of the humidity detected by said humidity detecting member.

11. An apparatus according to claim 7, wherein said controller sets at least one of the first and second high-absolute-value-voltage side duty ratios which decreases with increase of an image ratio per unit area.

12. An apparatus according to claim 7, wherein said controller controls a peak-to-peak voltage of the AC voltage such that a voltage value of a low absolute-value-voltage side is not less than a predetermined value.

13. An apparatus according to claim 7, wherein the AC voltage has a fixed frequency.

14. An image forming apparatus comprising:

a rotatable image bearing member configured to bear a toner image;

a transfer member constituting a transfer portion configured to transfer the toner image formed on said image bearing member onto a recording material;

a voltage source configured to apply, to said transfer member, a voltage in the form of superimposed DC voltage and AC voltage;

a controller configured to control said voltage source to change at least one of a high-absolute-value-voltage side duty ratio of the AC voltage and a peak-to-peak voltage of the AC voltage, on condition that the DC voltage and a time-integral of the voltage applied by said voltage source are not changed; and an executing portion configured to execute an operation by said controller in a first image forming mode in which the toner image is transferred from said image bearing member onto a first recording material with a first high-absolute-value-voltage side duty ratio and a first peak-to-peak voltage, and in a second image forming mode in which the toner image is transferred from said image bearing member onto a second recording material having a greater surface roughness than that of the first recording material, with a second high-absolute-value-voltage side duty ratio which is equal to or less than the first high-absolute-value-voltage side duty ratio and a second peak-to-peak voltage which is equal to or greater than the first peak-to-peak voltage.

15. An apparatus according to claim 14, further comprising a humidity detecting member configured to detect a humidity, wherein said controller decreases the high-absolute-value-voltage side duty ratio or increases the peak-to-peak voltage, with increase of the humidity detected by said humidity detecting member.

16. An apparatus according to claim 14, wherein said controller decreases the high-absolute-value-voltage side duty ratio or increases the peak-to-peak voltage with increase of an image ratio per unit area.

17. An apparatus according to claim 14, wherein said controller sets the peak-to-peak voltage of the AC voltage such that a voltage value of a low-absolute-value-voltage side is not less than a predetermined value.

18. An apparatus according to claim 14, wherein the AC voltage has a fixed frequency.

19. An image forming apparatus comprising:

a rotatable image bearing member configured to bear a toner image;

a transfer member constituting a transfer portion configured to transfer the toner image formed on said image bearing member onto a recording material;

a voltage source configured to apply, to said transfer member, a voltage in the form of superimposed DC voltage and AC voltage having a predetermined frequency;

a controller configured to control said voltage source to change a peak-to-peak voltage of the AC voltage, on condition that the DC voltage, the frequency of the AC voltage, and a time-integral of the voltage applied by the voltage source are not changed, in accordance with a kind of the recording material; and an executing portion configured to execute an operation by said controller in a first image forming mode in which the toner image is transferred from said image bearing member onto a first recording material with a first peak-to-peak voltage, and in a second image forming mode in which the toner image is transferred from said image bearing member onto a second recording material having a smaller surface roughness than that of the first recording material, with a second peak-to-peak voltage which is smaller than the first peak-to-peak voltage.

20. An apparatus according to claim 19, wherein the AC voltage has a fixed frequency.

21. An image forming apparatus comprising:

a rotatable image bearing member configured to bear a toner image;

a transfer member constituting a transfer portion configured to transfer the toner image formed on said image bearing member onto a recording material;

a voltage source configured to apply, to said transfer member, a voltage in the form of superimposed DC voltage and AC voltage;

a controller configured to control said voltage source to change a duty ratio of the AC voltage, on condition that the DC voltage, a peak-to-peak voltage of the AC voltage, and a time-integral of the voltage applied by said voltage source are not changed, in accordance with a kind of the recording material; and an executing portion configured to execute an operation by said controller in a first image forming mode in which the toner image is transferred from said image bearing member onto a first recording material with a first high-absolute-value-voltage side duty ratio, and in a second image forming mode in which the toner image is transferred from said image bearing member onto a second recording material having a larger surface roughness than that of the first recording material, with a second high-absolute-value-voltage side duty ratio which is smaller than the first high-absolute-value-voltage side duty ratio.

* * * * *